US010487493B2

(12) United States Patent
Collins et al.

(10) Patent No.: US 10,487,493 B2
(45) Date of Patent: Nov. 26, 2019

(54) BUILDING DESIGN AND CONSTRUCTION USING PREFABRICATED COMPONENTS

(71) Applicant: Innovative Building Technologies, LLC, Seattle, WA (US)

(72) Inventors: Arlan Collins, Seattle, WA (US); Mark Woerman, Seattle, WA (US)

(73) Assignee: Innovative Building Technologies, LLC, Seattle, WA (US)

( * ) Notice: Subject to any disclaimer, the term of this patent is extended or adjusted under 35 U.S.C. 154(b) by 0 days.

(21) Appl. No.: 15/975,325

(22) Filed: May 9, 2018

(65) Prior Publication Data

US 2018/0328017 A1 Nov. 15, 2018

Related U.S. Application Data

(60) Provisional application No. 62/505,650, filed on May 12, 2017.

(51) Int. Cl.
*E04B 1/00* (2006.01)
*E04B 1/04* (2006.01)
(Continued)

(52) U.S. Cl.
CPC ..... *E04B 1/04* (2013.01); *E04B 1/19* (2013.01); *E04B 1/24* (2013.01); *E04B 2/7409* (2013.01);
(Continued)

(58) Field of Classification Search
CPC ... E04H 1/005; E04B 1/2403; E04B 1/34315; E04B 1/348; E04B 1/043; E04B 1/2604;
(Continued)

(56) References Cited

U.S. PATENT DOCUMENTS 1,168,556 A 1/1916 Robinson et al.
1,501,288 A * 7/1924 Morley ..... E04B 1/20 52/236.8
(Continued)

FOREIGN PATENT DOCUMENTS

AU 2005200682 5/2005
AU 2012211472 2/2014
(Continued)

OTHER PUBLICATIONS

U.S. Appl. No. 12/796,603, issued Jun. 8, 2010, Collins et al.
(Continued)

*Primary Examiner* — Rodney Mintz

(57) ABSTRACT

A method of assembling a building unit in accordance with a floor plan of a building using prefabricated components may include installing a first prefabricated floor panel in a first position of the building unit, the first floor panel being selected from a first plurality of prefabricated floor panels having a same first width; installing a second prefabricated floor panel in a second position of the building unit, the second floor panel being selected from a second plurality of prefabricated floor panels having a same second width; and installing a third prefabricated floor panel in a third position of the building unit, the third floor panel being selected from a third plurality of prefabricated floor panels. The floor panels in the third plurality of prefabricated floor panels may have different widths. The third floor panel may be selected such that a sum of the widths of the first, second, and third floor panels corresponds to the total width of the building unit in accordance with the floor plan.

27 Claims, 18 Drawing Sheets

(51) Int. Cl.

| | |
|---|---|
| ***E04B 1/19*** | (2006.01) |
| ***E04B 1/24*** | (2006.01) |
| ***E04B 2/74*** | (2006.01) |
| ***E04B 5/02*** | (2006.01) |
| ***E04B 5/10*** | (2006.01) |
| ***E04B 5/12*** | (2006.01) |

(52) U.S. Cl.
CPC ..... *E04B 2/7457* (2013.01); *E04B 5/026* (2013.01); *E04B 5/10* (2013.01); *E04B 5/12* (2013.01); *E04B 1/003* (2013.01); *E04B 2001/2484* (2013.01); *E04B 2001/2496* (2013.01); *E04B 2002/7477* (2013.01); *E04B 2103/02* (2013.01); *E04B 2103/06* (2013.01)

(58) Field of Classification Search
CPC ... E04B 1/04; E04B 5/026; E04B 5/12; E04B 5/10; E04B 2/7457; E04B 2/7409; E04B 1/19; E04B 1/24; E04B 2001/2484; E04B 1/003; E04B 2002/7477; E04B 2001/2496; E04B 2103/02
See application file for complete search history.

(56) References Cited

U.S. PATENT DOCUMENTS 1,876,528 A 7/1931 Walters
1,883,376 A 10/1932 George et al.
2,160,161 A 5/1939 Marsh
2,419,319 A 4/1947 Lankton
2,495,862 A 1/1950 Osborn
2,562,050 A 7/1951 Lankton
2,686,420 A 8/1954 Youtz
2,722,724 A 11/1955 Walter
2,758,467 A 8/1956 Brown et al.
2,871,544 A 2/1959 Youtz
2,871,997 A 2/1959 Simpson et al.
2,877,990 A 3/1959 Goemann
2,946,413 A 7/1960 Weismann
3,017,723 A 1/1962 Von
3,052,449 A 9/1962 Long et al.
3,053,015 A 9/1962 George
3,053,509 A 9/1962 Haupt et al.
3,065,575 A 11/1962 Ray
3,079,652 A 3/1963 Wahlfeld
3,184,893 A 5/1965 Booth
3,221,454 A 12/1965 Giulio
3,235,917 A 2/1966 Skubic
3,236,014 A 2/1966 Edgar
3,245,183 A 4/1966 Tessin
3,281,172 A 10/1966 Kuehl
3,315,424 A 4/1967 Smith
3,355,853 A 12/1967 Wallace
3,376,919 A 4/1968 Agostino
3,388,512 A 6/1968 Newman
3,392,497 A 7/1968 Vantine
3,411,252 A 11/1968 Boyle, Jr.
3,460,302 A 8/1969 Cooper
3,490,191 A 1/1970 Ekblom
3,568,380 A * 3/1971 Stucky ..... E04B 1/22 52/223.13
3,579,935 A 5/1971 Regan et al.
3,590,393 A 7/1971 Hollander
3,594,965 A 7/1971 Saether
3,604,174 A 9/1971 Nelson, Jr.
3,608,258 A 9/1971 Spratt
3,614,803 A 10/1971 Matthews
3,638,380 A 2/1972 Perri
3,707,165 A 12/1972 Stahl
3,713,265 A 1/1973 Wysocki et al.
3,721,056 A 3/1973 Toan
3,722,169 A 3/1973 Boehmig
3,727,753 A 4/1973 Starr
3,742,666 A 7/1973 Antoniou
3,750,366 A 8/1973 Rich, Jr. et al.
3,751,864 A 8/1973 Berger et al.
3,755,974 A 9/1973 Berman
3,762,115 A 10/1973 McCaul, III
3,766,574 A 10/1973 Smid, Jr.
3,821,818 A 7/1974 Alosi
3,823,520 A 7/1974 Ohta et al.
3,845,601 A 11/1974 Kostecky
3,853,452 A 12/1974 Delmonte
3,885,367 A * 5/1975 Thunberg ..... E04B 1/24 52/127.11
3,906,686 A 9/1975 Dillon
3,921,362 A 11/1975 Ortega
3,926,486 A 12/1975 Sasnett
3,971,605 A 7/1976 Sasnett
3,974,618 A 8/1976 Cortina
3,990,202 A 11/1976 Becker
4,018,020 A 4/1977 Sauer et al.
4,038,796 A 8/1977 Eckel
4,050,215 A 9/1977 Fisher
4,059,936 A 11/1977 Lukens
4,065,905 A * 1/1978 van der Lely ..... E04B 1/3483 52/745.02
4,078,345 A 3/1978 Piazzalunga
4,107,886 A 8/1978 Ray
4,112,173 A 9/1978 Roudebush
4,114,335 A 9/1978 Carroll
4,142,255 A 3/1979 Togni
4,161,087 A 7/1979 Levesque
4,171,545 A 10/1979 Kann
4,176,504 A 12/1979 Huggins
4,178,343 A 12/1979 Rojo, Jr.
4,205,719 A 6/1980 Norell et al.
4,206,162 A 6/1980 Vanderklaauw
4,214,413 A 7/1980 de Los
4,221,441 A 9/1980 Bain
4,226,061 A 10/1980 Day, Jr.
4,248,020 A 2/1981 Zielinski et al.
4,251,974 A 2/1981 Vanderklaauw
4,280,307 A 7/1981 Griffin
4,314,430 A 2/1982 Farrington
4,325,205 A 4/1982 Salim
4,327,529 A 5/1982 Bigelow, Jr.
4,341,052 A 7/1982 Douglass, Jr.
4,361,994 A 12/1982 Carver
4,389,831 A 6/1983 Baumann
4,397,127 A 8/1983 Mieyal
4,435,927 A 3/1984 Umezu
4,441,286 A 4/1984 Skvaril
4,447,987 A 5/1984 Lesosky
4,447,996 A 5/1984 Maurer, Jr.
4,477,934 A 10/1984 Salminen
4,507,901 A 4/1985 Carroll
4,513,545 A 4/1985 Hopkins, Jr.
4,528,793 A 7/1985 Johnson
4,592,175 A * 6/1986 Werner ..... E04H 1/04 52/79.9
4,646,495 A 3/1987 Chalik
4,648,228 A 3/1987 Kiselewski
4,655,011 A 4/1987 Borges
4,688,750 A 8/1987 Teague et al.
4,712,352 A 12/1987 Low
4,757,663 A 7/1988 Kuhr
4,856,244 A 8/1989 Clapp
4,862,663 A 9/1989 Krieger
4,893,435 A 1/1990 Shalit
4,910,932 A * 3/1990 Honigman ..... E04B 1/08 52/280
4,918,897 A 4/1990 Luedtke
4,919,164 A 4/1990 Barenburg
4,974,366 A 12/1990 Tizzoni
4,991,368 A 2/1991 Amstutz
5,009,043 A 4/1991 Kurrasch
5,010,690 A 4/1991 Geoffrey
5,036,638 A 8/1991 Kurtz, Jr.
5,076,310 A 12/1991 Barenburg
5,079,890 A 1/1992 Kubik et al.
5,127,203 A 7/1992 Paquette
5,154,029 A 10/1992 Sturgeon

(56) References Cited

U.S. PATENT DOCUMENTS 5,185,971 A 2/1993 Johnson, Jr.
5,205,091 A 4/1993 Brown
5,212,921 A 5/1993 Unruh
5,228,254 A 7/1993 Honeycutt, Jr.
5,233,810 A 8/1993 Jennings
5,254,203 A 10/1993 Corston
5,307,600 A 5/1994 Simon, Jr.
5,359,820 A 11/1994 McKay
5,361,556 A 11/1994 Menchetti
5,402,612 A 4/1995 diGirolamo et al.
5,412,913 A 5/1995 Daniels et al.
5,426,894 A 6/1995 Headrick
5,452,552 A 9/1995 Ting
5,459,966 A 10/1995 Suarez
5,471,804 A 12/1995 Winter, IV
5,483,773 A 1/1996 Parisien
5,493,838 A 2/1996 Ross
5,509,242 A 4/1996 Rechsteiner et al.
5,519,971 A 5/1996 Ramirez
5,528,877 A 6/1996 Franklin
5,584,142 A 12/1996 Spiess
5,592,796 A 1/1997 Landers
5,611,173 A 3/1997 Headrick et al.
5,628,158 A 5/1997 Porter
5,640,824 A 6/1997 Johnson
5,660,017 A 8/1997 Houghton
5,678,384 A 10/1997 Maze
5,697,189 A 12/1997 Miller
5,699,643 A 12/1997 Kinard
5,706,607 A 1/1998 Frey
5,724,773 A 3/1998 Hall
5,746,034 A 5/1998 Luchetti et al.
5,755,982 A 5/1998 Strickland
5,850,686 A 12/1998 Mertes
5,867,964 A 2/1999 Perrin
5,870,867 A 2/1999 Mitchell
5,921,041 A 7/1999 Egri, II
5,970,680 A 10/1999 Powers
5,987,841 A 11/1999 Campo
5,992,109 A 11/1999 Jonker
5,997,792 A 12/1999 Gordon
6,000,194 A 12/1999 Nakamura
6,055,787 A 5/2000 Gerhaher et al.
6,073,401 A 6/2000 Chika et al.
6,073,413 A 6/2000 Tongiatama
6,076,319 A 6/2000 Hendershot
6,086,350 A 7/2000 Del Monte
6,154,774 A 11/2000 Furlong
6,170,214 B1 1/2001 Treister et al.
6,240,704 B1 6/2001 Porter
6,243,993 B1 6/2001 Swensson
6,244,002 B1 6/2001 Martin
6,244,008 B1 6/2001 Miller
6,260,329 B1 7/2001 Mills
6,289,646 B1 9/2001 Watanabe
6,301,838 B1 10/2001 Hall
6,308,465 B1 10/2001 Galloway et al.
6,308,491 B1 10/2001 Porter
6,340,508 B1 1/2002 Frommelt
6,371,188 B1 4/2002 Baczuk
6,393,774 B1 5/2002 Fisher
6,427,407 B1 8/2002 Wilson
6,430,883 B1 8/2002 Paz et al.
6,446,396 B1 9/2002 Marangoni et al.
6,481,172 B1 11/2002 Porter
6,484,460 B2 11/2002 VanHaitsma
6,625,937 B1 9/2003 Parker
6,651,393 B2 11/2003 Don
6,729,094 B1 5/2004 Spencer et al.
6,748,709 B1 6/2004 Sherman et al.
6,837,013 B2 1/2005 Foderberg et al.
6,922,960 B2 8/2005 Sataka
6,964,410 B1 11/2005 Hansen
7,007,343 B2 3/2006 Weiland
7,059,017 B1 6/2006 Rosko
7,143,555 B2 12/2006 Miller
RE39,462 E 1/2007 Brady
7,389,620 B1 6/2008 McManus
7,395,999 B2 7/2008 Walpole
7,444,793 B2 11/2008 Raftery et al.
7,467,469 B2 12/2008 Wall
7,484,339 B2 2/2009 Fiehler
7,493,729 B1 2/2009 Semmes
7,546,715 B2 6/2009 Roen
7,574,837 B2 8/2009 Hagen, Jr. et al.
7,658,045 B2 2/2010 Elliott et al.
7,676,998 B2 3/2010 Lessard
7,694,462 B2 4/2010 O'Callaghan
7,721,491 B2 5/2010 Appel
7,748,193 B2 7/2010 Knigge et al.
7,908,810 B2 3/2011 Payne, Jr. et al.
7,921,965 B1 4/2011 Surace
7,966,778 B2 6/2011 Klein
8,051,623 B2 11/2011 Loyd
8,096,084 B2 1/2012 Studebaker et al.
8,109,058 B2 2/2012 Miller
8,166,716 B2 5/2012 Macdonald et al.
8,234,827 B1 8/2012 Schroeder, Sr.
8,234,833 B2 8/2012 Miller
8,251,175 B1 8/2012 Englert et al.
8,276,328 B2 10/2012 Pépin
8,322,086 B2 12/2012 Weber
8,359,808 B2 1/2013 Stephens, Jr.
8,424,251 B2 4/2013 Tinianov
8,490,349 B2 7/2013 Lutzner
8,505,259 B1 8/2013 Degtyarev
8,539,732 B2 9/2013 Leahy
8,555,581 B2 10/2013 Amend
8,555,589 B2 10/2013 Semmens et al.
8,555,598 B2 10/2013 Wagner et al.
8,621,806 B2 1/2014 Studebaker et al.
8,621,818 B1 1/2014 Glenn et al.
8,631,616 B2 * 1/2014 Carrion ..... E04B 1/04 52/235
8,733,046 B2 5/2014 Naidoo
8,769,891 B2 * 7/2014 Kelly ..... E04B 1/08 52/234
8,826,613 B1 9/2014 Chrien
8,833,025 B2 9/2014 Krause
8,950,132 B2 2/2015 Collins et al.
8,966,845 B1 3/2015 Ciuperca
8,978,324 B2 3/2015 Collins et al.
8,991,111 B1 3/2015 Harkins
8,997,424 B1 4/2015 Miller
9,027,307 B2 * 5/2015 Collins ..... E04B 1/24 52/745.16
9,382,709 B2 7/2016 Collins et al.
9,683,361 B2 * 6/2017 Timberlake ..... E04C 5/0604
10,041,289 B2 8/2018 Collins et al.
10,323,428 B2 * 6/2019 Collins ..... E04H 1/005
2002/0059763 A1 5/2002 Wong
2002/0092703 A1 7/2002 Gelin et al.
2002/0134036 A1 9/2002 Daudet et al.
2002/0170243 A1 11/2002 Don
2003/0005653 A1 1/2003 Sataka
2003/0056445 A1 3/2003 Cox
2003/0084629 A1 5/2003 Strickland et al.
2003/0101680 A1 6/2003 Lee
2003/0140571 A1 7/2003 Muha et al.
2003/0167712 A1 9/2003 Robertson
2003/0167719 A1 9/2003 Alderman
2003/0200706 A1 10/2003 Kahan et al.
2003/0221381 A1 12/2003 Ting
2004/0065036 A1 4/2004 Capozzo
2004/0103596 A1 6/2004 Don
2005/0081484 A1 4/2005 Yland
2005/0108957 A1 5/2005 Quesada
2005/0188626 A1 9/2005 Johnson
2005/0188632 A1 9/2005 Rosen
2005/0198919 A1 9/2005 Hester, Jr.
2005/0204697 A1 9/2005 Rue
2005/0204699 A1 9/2005 Rue
2005/0210764 A1 9/2005 Foucher et al.
2005/0210798 A1 9/2005 Burg et al.

(56) References Cited

U.S. PATENT DOCUMENTS

2005/0235571 A1 10/2005 Ewing et al.
2005/0235581 A1 10/2005 Cohen
2005/0247013 A1 11/2005 Walpole
2005/0262771 A1 12/2005 Gorman
2006/0021289 A1 2/2006 Elmer
2006/0070321 A1 4/2006 Au
2006/0090326 A1 5/2006 Corbett
2006/0096202 A1 5/2006 Delzotto
2006/0117689 A1 6/2006 Onken et al.
2006/0137293 A1 6/2006 Klein
2006/0143856 A1 7/2006 Rosko et al.
2006/0150521 A1 7/2006 Henry
2006/0179764 A1 8/2006 Ito
2006/0248825 A1 11/2006 Garringer
2007/0000198 A1 1/2007 Payne
2007/0074464 A1 4/2007 Eldridge
2007/0107349 A1 5/2007 Erker
2007/0157539 A1 7/2007 Knigge et al.
2007/0163197 A1 7/2007 Payne et al.
2007/0209306 A1 9/2007 Andrews et al.
2007/0234657 A1 10/2007 Speyer et al.
2007/0283640 A1 12/2007 Shivak et al.
2007/0294954 A1 12/2007 Barrett
2008/0000177 A1 1/2008 Siu
2008/0057290 A1 3/2008 Guevara et al.
2008/0098676 A1 5/2008 Hutchens
2008/0099283 A1 5/2008 Reigwein
2008/0104901 A1 5/2008 Olvera
2008/0168741 A1 7/2008 Gilgan
2008/0178542 A1 7/2008 Williams
2008/0202048 A1 8/2008 Miller et al.
2008/0222981 A1 9/2008 Gobbi
2008/0229669 A1 9/2008 Abdollahzadeh et al.
2008/0245007 A1 9/2008 McDonald
2008/0282626 A1 11/2008 Powers, Jr.
2008/0289265 A1 11/2008 Lessard
2008/0295450 A1 12/2008 Yogev
2009/0031652 A1 2/2009 Ortega Gatalan
2009/0038764 A1 2/2009 Pilz
2009/0064611 A1 3/2009 Hall et al.
2009/0077916 A1 3/2009 Scuderi et al.
2009/0090074 A1 4/2009 Klein
2009/0100760 A1 4/2009 Ewing
2009/0100769 A1 4/2009 Barrett
2009/0107065 A1 4/2009 LeBlang
2009/0113820 A1 5/2009 Deans
2009/0134287 A1 5/2009 Klosowski
2009/0165399 A1 7/2009 Gines
2009/0188192 A1 7/2009 Studebaker et al.
2009/0188193 A1 7/2009 Studebaker et al.
2009/0205277 A1 8/2009 Gibson
2009/0249714 A1 10/2009 Combs et al.
2009/0277122 A1 11/2009 Howery et al.
2009/0282766 A1 11/2009 Roen
2009/0293395 A1 12/2009 Porter
2009/0313931 A1 12/2009 Porter
2010/0064590 A1 3/2010 Jones et al.
2010/0064601 A1 3/2010 Napier
2010/0146874 A1 6/2010 Brown
2010/0186313 A1 7/2010 Stanford et al.
2010/0212255 A1 8/2010 Lesoine
2010/0218443 A1 9/2010 Studebaker
2010/0229472 A1 9/2010 Malpas
2010/0235206 A1 9/2010 Miller et al.
2010/0263308 A1 10/2010 Olvera
2010/0275544 A1 11/2010 Studebaker et al.
2010/0325971 A1 12/2010 Leahy
2010/0325989 A1 12/2010 Leahy
2011/0023381 A1 2/2011 Weber
2011/0041411 A1 2/2011 Aragon
2011/0056147 A1* 3/2011 Beaudet ..... E04B 1/3483 52/79.9
2011/0113709 A1 5/2011 Pilz
2011/0113715 A1 5/2011 Tonyan et al.
2011/0126484 A1* 6/2011 Carrion ..... E04B 1/04 52/426
2011/0154766 A1 6/2011 Kralic et al.
2011/0162167 A1 7/2011 Blais
2011/0219720 A1 9/2011 Strickland et al.
2011/0247281 A1 10/2011 Pilz et al.
2011/0268916 A1 11/2011 Pardue, Jr.
2011/0296769 A1 12/2011 Collins et al.
2011/0296778 A1 12/2011 Collins et al.
2011/0296789 A1* 12/2011 Collins ..... E04B 1/24 52/741.4
2011/0300386 A1 12/2011 Pardue, Jr.
2012/0151869 A1 6/2012 Miller
2012/0167505 A1 7/2012 Krause
2012/0186174 A1 7/2012 LeBlang
2012/0210658 A1 8/2012 Logan
2012/0297712 A1 11/2012 Lutzner et al.
2012/0317923 A1 12/2012 Herdt et al.
2013/0025222 A1 1/2013 Mueller
2013/0025966 A1 1/2013 Nam et al.
2013/0036688 A1 2/2013 Gosain
2013/0067832 A1 3/2013 Collins et al.
2013/0111840 A1 5/2013 Bordener
2013/0133277 A1 5/2013 Lewis
2013/0232887 A1* 9/2013 Donnini ..... E04B 1/3442 52/79.5
2014/0013678 A1 1/2014 Deverini
2014/0013684 A1* 1/2014 Kelly ..... E04B 1/08 52/235
2014/0013695 A1 1/2014 Wolynski et al.
2014/0047780 A1 2/2014 Quinn et al.
2014/0059960 A1 3/2014 Cole
2014/0069035 A1 3/2014 Collins et al.
2014/0069040 A1 3/2014 Gibson
2014/0069050 A1 3/2014 Bolin
2014/0083046 A1 3/2014 Yang
2014/0090323 A1 4/2014 Glancy
2014/0130441 A1 5/2014 Sugihara et al.
2014/0317841 A1 10/2014 DeJesus et al.
2015/0096251 A1 4/2015 McCandless et al.
2015/0211227 A1 7/2015 Collins et al.
2015/0233108 A1 8/2015 Eggleston, II et al.
2015/0252558 A1 9/2015 Chin
2016/0053475 A1 2/2016 Locker et al.
2016/0122996 A1* 5/2016 Timberlake ..... E04C 5/0604 52/236.3
2016/0290030 A1 10/2016 Collins et al.
2016/0319534 A1* 11/2016 Bernardo ..... E04B 1/3483
2017/0284095 A1* 10/2017 Collins ..... E04C 2/284
2017/0299198 A1* 10/2017 Collins ..... E04C 2/50
2017/0306624 A1 10/2017 Graham et al.
2017/0306625 A1* 10/2017 Collins ..... E04C 2/288
2018/0038103 A1 2/2018 Neumayr
2018/0209136 A1* 7/2018 Aylward ..... E04B 1/3483
2018/0328056 A1* 11/2018 Collins ..... E04H 1/005
2019/0032327 A1* 1/2019 Musson ..... E04B 1/34807
2019/0136508 A1* 5/2019 Chaillan ..... E04B 1/34823

FOREIGN PATENT DOCUMENTS

CN 20137279 3/2008
CN 101821462 9/2010
CN 101831963 9/2010
CN 102459775 5/2012
CN 102587693 7/2012
CN 202299241 7/2012
CN 202391078 8/2012
CN 102733511 10/2012
DE 4205812 9/1993
DE 20002775 8/2000
DE 19918153 11/2000
DE 20315506 11/2004
DE 202008007139 10/2009
EP 1045078 10/2000
EP 0235029 2/2002
EP 1375804 1/2004
EP 2128353 12/2009
EP 2213808 8/2010

(56) References Cited

FOREIGN PATENT DOCUMENTS

| | | | |
|---|---|---|---|
| EP | 2238872 | 10/2010 | |
| EP | 1739246 | 1/2011 | |
| EP | 2281964 | 2/2011 | |
| EP | 3133220 | 2/2017 | |
| FR | 1317681 | 5/1963 | |
| FR | 2988749 | 10/2013 | |
| FR | 2765906 | 1/2019 | |
| GB | 898905 | 6/1962 | |
| JP | 52-015934 | 4/1977 | |
| JP | 53-000014 | 1/1978 | |
| JP | 53-156364 | 12/1978 | |
| JP | S54-084112 | 6/1979 | |
| JP | 56-131749 | 10/1981 | |
| JP | 57-158451 | 9/1982 | |
| JP | 61-144151 | 9/1986 | |
| JP | H0310985 | 1/1991 | |
| JP | H049373 | 3/1992 | |
| JP | 6-12178 | 2/1994 | |
| JP | H0752887 | 12/1995 | |
| JP | 8-189078 | 7/1996 | |
| JP | 2576409 | 4/1998 | |
| JP | 10234493 | 9/1998 | |
| JP | H10245918 | 9/1998 | |
| JP | 2000-34801 | 2/2000 | |
| JP | 2000144997 | 5/2000 | |
| JP | 2000-160861 | 6/2000 | |
| JP | 3137760 | 2/2001 | |
| JP | 3257111 | 2/2002 | |
| JP | 2002536615 | 10/2002 | |
| JP | 2002364104 | 12/2002 | |
| JP | 2003-278300 | 10/2003 | |
| JP | 2004108031 | 4/2004 | |
| JP | 3664280 | 6/2005 | |
| JP | 2006-161406 | 6/2006 | |
| JP | 3137760 | 12/2007 | |
| JP | 2008073434 | 4/2008 | |
| JP | 2008110104 | 5/2008 | |
| JP | 2010245918 | 10/2010 | |
| JP | 3187449 | 11/2013 | |
| JP | 2015-117502 | 6/2015 | |
| KR | 1019990052255 | 7/1999 | |
| KR | 1019990053902 | 7/1999 | |
| KR | 100236196 | 12/1999 | |
| KR | 102000200413000 | 10/2000 | |
| KR | 20060066931 | 6/2006 | |
| KR | 20180092677 | 8/2018 | |
| WO | 1991007557 | 5/1991 | |
| WO | 1997022770 | 6/1997 | |
| WO | 200046457 | 8/2000 | |
| WO | 0058583 | 10/2000 | |
| WO | 2002035029 | 5/2002 | |
| WO | 2007059003 | 5/2007 | |
| WO | 2007080561 | 7/2007 | |
| WO | 2010030060 | 3/2010 | |
| WO | 2010037938 | 4/2010 | |
| WO | WO-2015050502 A1 * | 4/2015 | ..... E04C 2/049 |
| WO | 2016032537 | 3/2016 | |
| WO | 2016032538 | 3/2016 | |
| WO | 2016032539 | 3/2016 | |
| WO | 2016032540 | 3/2016 | |
| WO | 2016033429 | 3/2016 | |
| WO | 2016033525 | 3/2016 | |

OTHER PUBLICATIONS

EPO, European Search Report received for POT 14891125.8-1604/3011122 dated Jul. 8, 2016, 4 pages.

EPO, European Search Report in PCT/US2015/047383 dated Jun. 22, 2018, 10 Pages.

WIPO, International Search Report and Written opinion for International Application No. PCT/US/2014/053614 dated Dec. 18, 2014, 11 pages.

WIPO, International Search Report and Written opinion for International Application No. PCT/US/2014/053615 dated Dec. 17, 2014, 11 pages.

WIPO, International Search Report and Written opinion for International Application No. PCT/US/2014/053613 dated Dec. 18, 2014, 13 Pages.

WIPO, International Search Report and Written Opinion for International Application No. PCT/US2011/001039 dated Oct. 5, 2011, 14 Pages.

WIPO, International Search Report and Written opinion for International Application No. PCT/US2015/047383 dated Jan. 12, 2016, 14 Pages.

WIPO, International Search Report and Written opinion for International Application No. PCT/US15/47536 dated Dec. 4, 2015, 17 Pages.

WIPO, International Search Report and Written opinion for International Application No. PCT/US/2014/053616 dated Dec. 17, 2014, 9 Pages.

WIPO, International Search Report and Written Opinion for PCT Application No. PCT/US2011/001039 dated Oct. 5, 2011, 9 Pages.

Beam to column connection, TATA Steel, http://www.tatasteelconstruction.com/en/reference/teaching_resources/architectural_studio_reference/elements/connections/beam to column connections, 2014, 4 Pages.

Emerging Trends 2012 Executive Summary, Urban Land Institute, Ch. 1, 2011, 1-11 Pages.

Emerging Trends in real estate, accessed on Sep. 15, 2016 at https://web.archive.orglweb120140813084823/http://pwc.corn.au/industry/real-estate/assets/Real-Estate-2012-Europe-Jan12.pdf, pp. 60, 2012.

Extended European Search Report for European Application No. EP 15836516.3, dated Jun 22, 2018, 1 Page.

Extended European Search Report for European Patent Application No. 14900469, dated Mar. 20, 2018, 1-8 pages.

How to Soundproof a Ceiling—Soundproofing Ceilings, http://www.soundproofingcompany.com/soundproofing-solutions/soundproof-a-ceiling/, Apr. 2, 2014, 1-7 Pages.

Insulspan Installation Guide, Obtained at: http://www.insuispan.comidownloads:InstallationGuide,pdf on Feb. 2, 2016, 58 pages.

Structural Insulated Panel, Wikipedia, http://www.en.wikipedia.org//wiki/Structural_insulated_panel, May 30, 2014, 5 Pages.

Structural Insulated Panels, SIP Solutions, http://www.sipsolutions.com/content/structuralinsulated-panels, Aug. 15, 2014, 3 pages.

US Apartment & Condominium Construction Forecast 2003-2017, Statista, Inc., Jun. 2012, 8 Pages.

Azari, et al., Modular Prefabricated Residential Construction—Constraints and Opportunities, PNCCRE Technical Report #TR002, Aug. 2013, 90 Pages.

Borzouie, Jamaledin, et al., Seismic Assesment and Reahbilitation of Diaphragms, http://www.nosazimadares.ir/behsazi/15WCEE2012/URM/1/Roof.pdf, Dec. 31, 2011, 86 Pages.

EPO, Communication Pursuant to Article 94(3) EPC mailed for EP application No. 15836516.3, dated Apr. 25, 2019, 4 pages.

Framecad, FC EW 1-12mm Fibre Cement Sheet + 9mm MgO Board Wall Assembly, 2013, 2 pages.

Giles, et al., Innovations in the Development of Industrially Designed and Manufactured Modular Concepts for Low-Energy, Multi-Story, High Density, Prefabricated Affordable Housing, Innovations in the Development of Industrially Designed and Manufactured Modular Concepts, 2006, 1-15 Pages.

Gonchar, Paradigm Shift—Multistory Modular, Architectural Record, Oct. 2012, 144-148 Pages.

Kerin, et al., National Apartment Market Report—2013, Marcus & Millichap, 2013, 1-9 pages.

M.A. Riusillo, Lift Slab Construction: Its History, Methodology, Economics and Applications, ACI-Abstract, Jun. 1, 1988, 2 pages.

Mcilwain, Housing in America—The Next Decade, Urban Land Institute, 2010, 1-28 Pages.

Mcilwain, The Rental Boost From Green Design, Urban Land, http://urbanland.uli.org/sustainability/the-rental-boost-from-green-design/, Jan. 4, 2012, 1-6 Pages.

Shashaty, Andre, Housing Demand, Sustainable Communities, Apr. 2011, 14-18 Pages.

(56) References Cited

OTHER PUBLICATIONS

Sichelman, Severe Apartment Shortage Looms, Urban Land, http://urbanland.uli.org/capital-markets/nahb-orlando-severe-apartmentshortage-looms/, Jan. 13, 2011, 1-2 Pages.
Stiemer, S F, Bolted Beam-Column Connections, http://faculty.philau.edu/pastorec/Tensile/bolted_beam_column_connections.pdf, Nov. 11, 2007, 1-16 Pages.
WIPO, International Search Report for International Patent Application No. PCT/US2017/021174, dated Jun. 26, 2017, 11 pages.
WIPO, International Search Report for International Patent Application No. PCT/US2017/021168, dated May 19, 2017, 5 pages.
WIPO, Written Opinion for International Patent Application No. PCT/US2017/021174, dated Jun. 26, 2017, 6 pages.
WIPO, International Search Report for International Patent Application No. PCT/US2017/021179, dated May 25, 2017, 7 pages.
WIPO, Written Opinion for International Patent Application No. PCT/US2017/021179, dated May 25, 2017, 7 pages.
WIPO, International Search Report of International Patent Application No. PCT/US2017/021177, dated Jun. 5, 2017, 8 pages.
WIPO, Written Opinion of International Patent Application No. PCT/US2017/021177, dated Jun. 5, 2017, 8 pages.
WIPO, Written Opinion for International Patent Application No. PCT/US2017/021168, dated May 19, 2017, 8 pages.
WIPO, International Search Report and Written Opinion mailed for International application No. PCT/US2014/053614 dated Dec. 18, 2014, 11 pages.
WIPO, International Search Report and Written Opinion mailed for International application No. PCT/US2014/053615 dated Dec. 17, 2014, 11 Pages.
WIPO, International Search Report and Written Opinion mailed for International application No. PCT/US2014/053613 dated Dec. 18, 2014, 13 pages.
WIPO, International Search Report and Written Opinion mailed for International application No. PCT/US2015/047536 dated Dec. 4, 2015, 17 Pages.
WIPO, International Search Report and Written Opinion mailed for International application No. PCT/US2014/053616 dated Dec. 17, 2014, 9 Pages.
EPO, Communication Pursuant to Article 94(3) EPC mailed for European patent application No. 14900469.9, dated Jun. 18, 2019, 5 pages.
EPO, Communication Pursuant to Article 94(3) EPC for European Patent Application No. 15836516.3, dated Aug. 2, 2019, 4 pages.
WIPO, International Search Report and Written Opinion mailed for International application No. PCT/US2019/031307, dated Aug. 7, 2019, 11 pages.
EPO, International Search Report and Written Opinion for PCT Application No. PCT/EP2019/38557, dated Sep. 4, 2019, 67 pages.
EPO, Extended European Search Report for European Patent Application No. 17763907.7, dated Sep. 13, 2019, 13 pages.

* cited by examiner

BUILDING DESIGN AND CONSTRUCTION USING PREFABRICATED COMPONENTS

BACKGROUND

Conventional construction is conducted in the field at the building job site. People in various trades (e.g., carpenters, electricians, and plumbers) measure, cut, and install material as though each unit were one-of-a-kind. Furthermore, activities performed by the trades are arranged in a linear sequence. The result is a time-consuming process that increases the risk of waste, installation imperfections, and cost overruns. One approach to improving efficiency in building construction may be modular construction. In the case of buildings with multiple dwelling units (e.g., apartments, hotels, student dorms, etc.), entire dwelling units (referred to as modules) may be built off-site in a factory and then trucked to the job site. The modules are then stacked and connected together, generally resulting in a low-rise construction (e.g., between one and six stories). Other modular construction techniques may involve the building of large components of the individual units off-site (e.g., in a factory) and assembling the large components in the field to reduce the overall construction effort at the job site and thereby reducing the overall time of erecting the building. However, shortcomings may exist with known modular building technologies and improvements thereof may be desirable.

SUMMARY

Techniques are generally described that include methods and systems relating to building construction and more specifically relating to building design and construction using prefabricated components. An example method may include assembling a building unit in accordance with a floor plan of a building using prefabricated components, wherein the floor plan is designed to provide a total width of the building unit. The method may include installing a first prefabricated floor panel in a first position of the building unit, wherein the first floor panel is selected from a first plurality of prefabricated floor panels having a same first width; installing a second prefabricated floor panel in a second position of the building unit, wherein the second floor panel is selected from a second plurality of prefabricated floor panels having a same second width; and installing a third prefabricated floor panel in a third position of the building unit, wherein the third floor panel is selected from a third plurality of prefabricated floor panels, the floor panels in the third plurality of prefabricated floor panels having different widths, and wherein the third floor panel is selected such that a sum of the widths of the first, second, and third floor panels corresponds to the total width of the building unit in accordance with the floor plan.

In some examples, the first, second, and third pluralities of prefabricated floor panels may have a variable length. The first, second, and third floor panels may be selected to have the same length. The lengths of the first, second, and third floor panels may be selected to achieve a desired total length of the building unit.

In some examples, the first width of the first plurality of prefabricated floor panels may be equal to the second width of the second plurality of prefabricated floor panels. The first and second widths of the first and second pluralities of prefabricated floor panels may be greater than the widths of the third plurality of prefabricated floor panels.

In some examples, the third floor panel may be positioned between the first and second floor panels.

In some examples, the method may include installing a plurality of prefabricated walls to define one or more interior rooms of the building unit. Installing a plurality of prefabricated walls may include installing a prefabricated utility wall along a terminal side of the building unit, and installing a prefabricated demising wall along a terminal end of the building unit, the prefabricated demising wall configured to partition the building unit from an adjacent building unit. The first floor panel may be positioned adjacent to the utility wall. Installing a plurality of prefabricated walls may include installing a window wall along a terminal side of the building unit opposite the utility wall. The second floor panel may be positioned adjacent to the window wall. Installing a plurality of prefabricated walls may include installing a prefabricated end wall along a terminal end of the building unit opposite the demising wall, the prefabricated end wall positioned to extend along a terminal end of the building. Installing a plurality of prefabricated walls may include installing a prefabricated bedroom wall within the interior of the building unit to partition the building unit into a plurality of rooms.

Another example method includes assembling a building unit in accordance with a floor plan using prefabricated components. The method may include installing a first prefabricated floor panel to and between adjacent floor beams, installing a second prefabricated floor panel to and between the adjacent floor beams, installing a third prefabricated floor panel to and between the adjacent floor beams, installing a prefabricated demising wall above and along at least one of the adjacent floor beams, and installing a prefabricated utility wall between the adjacent floor beams. The first floor panel may be selected from a first plurality of prefabricated floor panels having a same first width. The second floor panel may be selected from a second plurality of prefabricated floor panels having a same second width. The third floor panel may be selected from a third plurality of prefabricated floor panels. Each floor panel in the third plurality of prefabricated floor panels may have a different width. The prefabricated demising wall may be selected from a plurality of prefabricated demising walls. Each demising wall in the plurality of prefabricated demising walls may have a different length. The demising wall may be configured to partition the building unit from an adjacent building unit. The prefabricated utility wall may be selected from a plurality of prefabricated utility walls. Each utility wall in the plurality of prefabricated utility walls may have a different length. The utility wall may be positioned along a terminal side of the building unit.

In some examples, the method may include installing a prefabricated end wall above and along at least one of the adjacent floor beams. The end wall may be selected from a plurality of prefabricated end walls. Each end wall in the plurality of prefabricated end walls may have a different length. The lengths of the prefabricated demising and end walls may vary according to the width of the prefabricated third floor panel.

In some examples, the method may include installing a window wall between the adjacent floor beams along a terminal side of the building unit opposite the prefabricated utility wall.

In some examples, the first floor panel, the second floor panel, and the third floor panel may have the same lengths.

Another example method includes constructing a building from a limited set of prefabricated components, the building having a length and a width. The method may include erecting a structural frame and installing first and second prefabricated floor panels to the structural frame. The structural frame may include first and second rows of columns along the length of the building and a plurality of floor beams coupled to and between the first and second rows of columns such that the plurality of floor beams extend substantially parallel to one another along the width of the building. The first and second prefabricated floor panels may be installed to and between adjacent floor beams of the plurality of floor beams. The first prefabricated floor panel may have a width. The second prefabricated floor panel may be selected from a plurality of prefabricated floor panels, each floor panel in the second plurality of prefabricated floor panels having a different width. The width of the second prefabricated floor panel may be selected such that a sum of the width of the first prefabricated floor panel and the width of the second prefabricated floor panel is less than or equal to a total width of a building unit.

In some examples, the method may include installing a third prefabricated floor panel to and between the adjacent floor beams of the plurality of floor beams, the third prefabricated floor panel having a width. The width of the second prefabricated floor panel may be selected such that the sum of the widths of the first, second, and third prefabricated floor panels corresponds to the total width of the building unit. The width of the third prefabricated floor panel may be equal to the width of the first prefabricated floor panel. The second prefabricated floor panel may be positioned between the first and third prefabricated floor panels.

In some examples, the method may include installing a plurality of prefabricated walls to define one or more building units of the building. Installing a plurality of prefabricated walls may include installing a prefabricated utility wall along a first side of the building unit such that the prefabricated utility wall extends along at least a portion of the length of the building and at least partially defines the envelope of the building. Installing a plurality of prefabricated walls may include installing a prefabricated demising wall along a second side of the building unit such that the prefabricated demising wall extends along at least a portion of the width of the building. The prefabricated demising wall may be configured to partition the building unit from an adjacent building unit. Installing a plurality of prefabricated walls may include installing a window wall opposite the utility wall. Installing a plurality of prefabricated walls may include installing a prefabricated end wall opposite the demising wall, the prefabricated end wall positioned to at least partially define the envelope of the building. Installing a plurality of prefabricated walls may include installing a prefabricated bedroom wall within the interior of the building unit to partition the building unit into a plurality of rooms.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several examples in accordance with the disclosure and are, therefore, not to be considered limiting of its scope, the disclosure will be described with additional specificity and detail through use of the accompanying drawings, in which:

Figure 1:
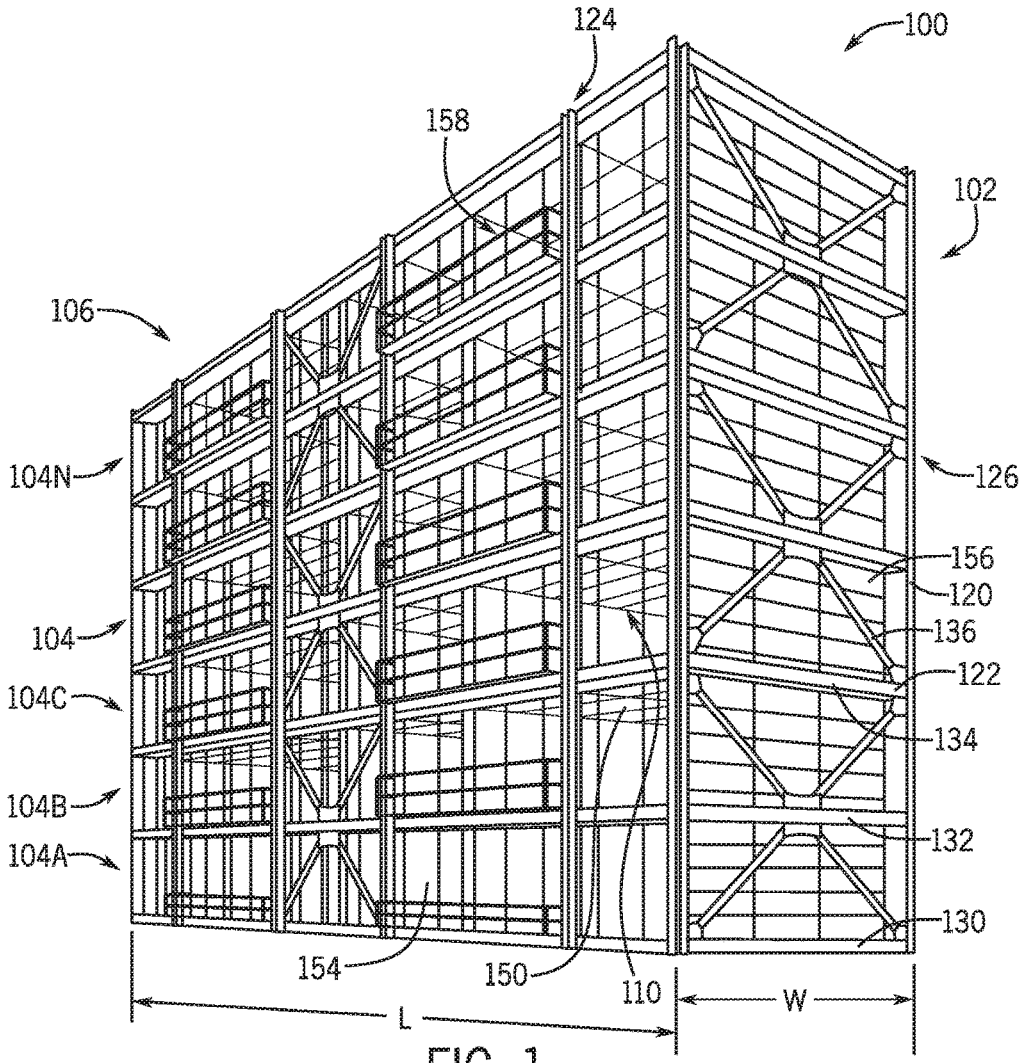
FIG. 1 is a schematic illustration of an example multi-story building assembled from prefabricated components.

all arranged in accordance with at least some embodiments of the present disclosure.

DETAILED DESCRIPTION

In the following detailed description, reference is made to the accompanying drawings, which form a part hereof. In the drawings, similar symbols typically identify similar components, unless context dictates otherwise. The illustrative examples described in the detailed description, drawings, and claims are not meant to be limiting. Other examples may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are implicitly contemplated herein.

This disclosure is drawn, inter alia, to methods, systems, products, devices, and/or apparatus generally related to constructing a building from prefabricated components. In some examples, the prefabricated components may be assembled off-site (such as in a shop) and then transported to the building site for constructing a building. At the building site, the prefabricated components may be attached together and/or to a building frame, either directly or indirectly. The building frame may be an external frame. The term external frame, also referred to as external structural frame, will be understood to refer to a structural frame of a building which is arranged generally externally to the envelope of the building. This is, in contrast to other types of structural frames that include vertical and horizontal load bearing members located within the perimeter defined by the building envelope, as is typical in timber construction for example, the external frame is arranged outside the perimeter of the building envelope. As is generally known in the field of structural engineering, the structural frame is the load-resisting or load-bearing system of a building which transfers loads (e.g., vertical and lateral loads) into the foundation of the building trough interconnected structural components (e.g., load bearing members, such as beams, columns, load-bearing walls, etc.).

In some examples of the present disclosure, a building design and construction using prefabricated components is provided. For example, according to various examples described herein, a method of assembling a building unit in accordance with a floor plan of a building using prefabricated components is provided. As described herein, the method includes installing a plurality of prefabricated components to define one or more building units of the building. In this manner, the building may be constructed with improved efficiency and/or reduced cost compared to typical multi-story building construction. For example, the building sequence disclosed herein may remove one or more steps from a conventional building construction process, such as removing the step of pouring/curing concrete walls and floors as is typical in some multi-story building construction.

As one example, the method may include installing a first prefabricated floor panel in a first position of the building unit, installing a second prefabricated floor panel in a second position of the building unit, and installing a third prefabricated floor panel in a third position of the building unit. The first floor panel may be selected from a first plurality of prefabricated floor panels having a same first width. The second floor panel may be selected from a second plurality of prefabricated floor panels having a same second width. The third floor panel may be selected from a third plurality of prefabricated floor panels, the floor panels in the third plurality of prefabricated floor panels having different widths. The third floor panel may be selected such that a sum of the widths of the first, second, and third floor panels corresponds to the total width of the building unit in accordance with the floor plan.

As another example, the method may include installing a first prefabricated floor panel to and between adjacent floor beams, installing a second prefabricated floor panel to and between the adjacent floor beams, installing a third prefabricated floor panel to and between the adjacent floor beams, installing a prefabricated demising wall above and along at least one of the adjacent floor beams, and installing a prefabricated utility wall between the adjacent floor beams. The first floor panel may be selected from a first plurality of prefabricated floor panels having a same first width. The second floor panel may be selected from a second plurality of prefabricated floor panels having a same second width. The third floor panel may be selected from a third plurality of prefabricated floor panels. Each floor panel in the third plurality of prefabricated floor panels may have a different width. The prefabricated demising wall may be selected from a plurality of prefabricated demising walls. Each demising wall in the plurality of prefabricated demising walls may have a different length. The demising wall may be configured to partition the building unit from an adjacent building unit. The prefabricated utility wall may be selected from a plurality of prefabricated utility walls. Each utility wall in the plurality of prefabricated utility walls may have a different length. The utility wall may be positioned along a terminal side of the building unit.

As another example, the method may include erecting a structural frame and installing first and second prefabricated floor panels to the structural frame. The structural frame may include first and second rows of columns along the length of the building and a plurality of floor beams coupled to and between the first and second rows of columns such that the plurality of floor beams extend substantially parallel to one another along the width of the building. The first and second prefabricated floor panels may be installed to and between adjacent floor beams of the plurality of floor beams. The first prefabricated floor panel may have a width. The second prefabricated floor panel may be selected from a plurality of prefabricated floor panels, each floor panel in the second plurality of prefabricated floor panels having a different width. The width of the second prefabricated floor panel may be selected such that a sum of the width of the first prefabricated floor panel and the width of the second prefabricated floor panel is less than or equal to a total width of a building unit.

In referring now to the drawings, repeating units of the same kind or generally fungible kind are designated by the part number and a letter (e.g., 214n), where the letters "a", "b", "c" and so on refer to a discrete number of the repeating items. General reference to the part number followed by the letter "n" indicates there is no predetermined or established limit to the number of items intended. The parts are listed as "a-n" referring to starting at "a" and ending at any desired number "n".

FIG. 1 illustrates an example building 100 arranged in accordance with at least some embodiments described herein. FIG. 1 shows the building 100 including a structural frame 102 and one or more floors, levels, or stories 104. When assembled or constructed, the building 100 has a width W and a length L, which in some examples is greater than the building's width W. In such embodiments, the sides of the building 100 defining the length L of the building 100 may be referred to as terminal sides of the building 100. In like manner, the sides of the building 100 defining the width W of the building 100 may be referred to as terminal ends of the building 100. As described more fully below, the building 100 may be constructed by assembling various prefabricated components 106 (such as prefabricated columns, beams, floor panels, and walls) together. As described herein, the prefabricated components 106 may be assembled independent of one another remotely from the building site and transported to the building site for installation. As described herein, the prefabricated components 106 may include all components or substantially all of the components for a particular system of the building 100, such as a floor system or a wall system of the building 100. As explained below, the prefabricated components 106 may fit, or otherwise be coupled, together to complete the various systems of the building 100. For example, the prefabricated components 106 may be coupled or otherwise attached to the structural frame 102, to adjacent prefabricated components 106, or to both the structural frame 102 and one or more adjacent prefabricated components 106 at the building site to define the building 100, as more fully explained below.

Using prefabricated components 106, the building 100 may be constructed or assembled in reduced time and with a reduced amount of waste when compared to traditional construction methods. For example, in typical multi-story building construction, the various systems of a building may be constructed or assembled in situ, sometimes requiring large or vast storage and staging areas, numerous tools and construction equipment, as well as complicated (and inefficient) inventory and scheduling management. Large amounts of waste are also produced in typical multi-story building construction as each system is assembled or constructed on site. This waste may be detrimental to the construction process, such as increasing building costs and/or cluttering the construction area, which may cause otherwise preventable injuries from trips and falls.

On the other hand, implementing the various examples herein may reduce waste and reduce the time necessary to construct building 100. For example, and without limitation, because the various prefabricated components 106 fit, or are otherwise coupled, together, there is little to no construction waste produced at the jobsite, thereby creating a cleaner (and more efficient) jobsite. The examples of the present disclosure may also require storage and staging areas that are substantially smaller than those of typical multi-story building construction. For example, the prefabricated components 106 may be lifted off of a delivery truck and immediately placed in position without requiring preparation of the components in a staging area. Thus, the examples of the present disclosure may be beneficial for building sites where there is little to no room for storage or staging areas, such as in crowded metropolitan areas.

As shown in FIG. 1, the building 100 may include multiple building modules or units 110. The building units 110 may be commercial, residential (e.g., dwelling units, residences, etc.), or both. The building units 110 may be assembled at the building site using multiple pre-assembled or prefabricated components 106. Each building unit 110 may be assembled in accordance with a floor plan of the building 100. For example, in accordance with a floor plan, each story 104 of the building 100 may include one or multiple building units 110 defined by the prefabricated components 106. For example, depending on the size of the building 100, the desired number of building units 110, and/or local zoning and building requirements, each story 104 of the building 100 may include one, two, three, four, or more building units 110. In some embodiments, a building unit 110 may span more than one floor of the building 100 to define a multi-story building unit (e.g., a two-story building unit).

The building units 110 may be standardized and repetitive, or unique and individualized. Mixed units of standard size and shape may be combined with unique units in the same story 104, or in independent arrangement on separate stories 104. Additionally or alternatively, the building units 110 of each story 104 may be repetitive or mixed. For example, each building unit 110 on one story 104 may be identical to one another. In such examples, each building unit 110 on another story 104 may be identical to one another but different from other stories 104. Additionally or alternatively, a story 104 of the building 100 may include multiple building units 110 with a building unit 110 of the story 104 assembled differently than at least another building unit 110 of the same story 104. In one example, the building units 110 on the same end of the building 100 may be assembled identically. In other examples, the building units 110 within the interior of each story 104 may be assembled identically. In some examples, each vertically adjacent building unit 110 may be assembled identically. The foregoing examples are meant to be illustrative only, and the building units 110 of the building 100 may be assembled in accordance with any permutation or combination of configurations.

With continued reference to FIG. 1, the building 100 may include a structural frame 102 providing structural support for the building 100. The structural frame 102, which may be at least partially external to the building 100 in some examples, may serve at least partially as a structural skeleton (such as an exoskeleton) of the building 100. The structural frame 102 may include multiple support members, such as a plurality of columns 120 and a plurality of beams 122. The columns 120, which may be referred to as load bearing members, may be oriented vertically. The beams 122, which may be referred to as floor beams, may be oriented horizontally.

The beams 122 may extend between and be attached to adjacent columns 120 to at least partially define a structural framework of the building 100. For example, the structural frame 102 may include first and second rows of columns 124, 126 extending along the length L of the building 100, and a plurality of beams 122 coupled to and between the first and second rows of columns 124, 126 such that the beams 122 extend substantially parallel to one another along the width W of the building 100. For example, a plurality of first floor beams 130 may be installed to and between the columns 120 (e.g., to and between the first and second rows of columns 124, 126) to at least partially define a structural framework for a first story 104A of the building 100. Similarly, a plurality of vertically adjacent beams 122, such as a plurality of second floor beams 132, may be installed to and between the columns 120 (e.g., to and between the first and second rows of columns 124, 126) to at least partially define a structural framework for a vertically adjacent story 104 (e.g., a second story 104B) of the building 100. In like manner, a plurality of third floor beams 134 may be installed to and between the columns 120 (e.g., to and between the first and second rows of columns 124, 126) to at least partially define a structure framework for a third story 104C of the building 100. This framework may be repeated to define a desired number of stories 104 of the building 100, such as up to an $n^{th}$ story 104N of the building 100, as explained below.

The beams 122 may be attached or otherwise coupled to the columns 120 in substantially any suitable manner, such as by welding and/or by bolting the components together. In such examples, various prefabricated components 106 (e.g., prefabricated floors and walls) may be attached or otherwise coupled to the beams 122 and/or to the columns 120. For example, as detailed below, prefabricated floors and walls may be attached or otherwise coupled to the beams 122 and/or to the columns 120 to define the various building units 110 of each story 104 of the building 100.

In some embodiments, the structural frame 102 may include additional structural elements, such as one or more cross braces 128 extending between, such as obliquely to, the columns 120 and the beams 122, to provide additional stiffness to the structural frame 102, such as increasing the lateral stability of the building 100. The structural frame 102 may be configured to provide most, or substantially all, the structural support for the building 100. In some embodiments, the structural frame 102 may provide a desired aesthetic appeal (e.g., architectural design, decoration, etc.) or added support to the building 100.

The various components shown in FIG. 1 are merely illustrative, and other variations, including eliminating components, combining components, and substituting components are all contemplated. Though FIG. 1 shows the building 100 as a six-story building, the building 100 may include any number of suitable stories 104 depending on the particular application, as explained below. For example, the building 100 may include any number of stories 104 limited only by local zoning and building codes, among others. In embodiments where the building 100 includes two or more stories 104, the building 100 may be considered a multi-story building. In such examples, the building 100 may be classified as a low-rise, a mid-rise, or a high-rise construction depending on the number of stories 104. In some embodiments, the building 100 may be a residential multi-dwelling building having one or more stories 104, such as one story 104, two stories 104, six stories 104, ten stories 104, thirty stories 104, more than thirty stories 104, or the like.

Figure 2:
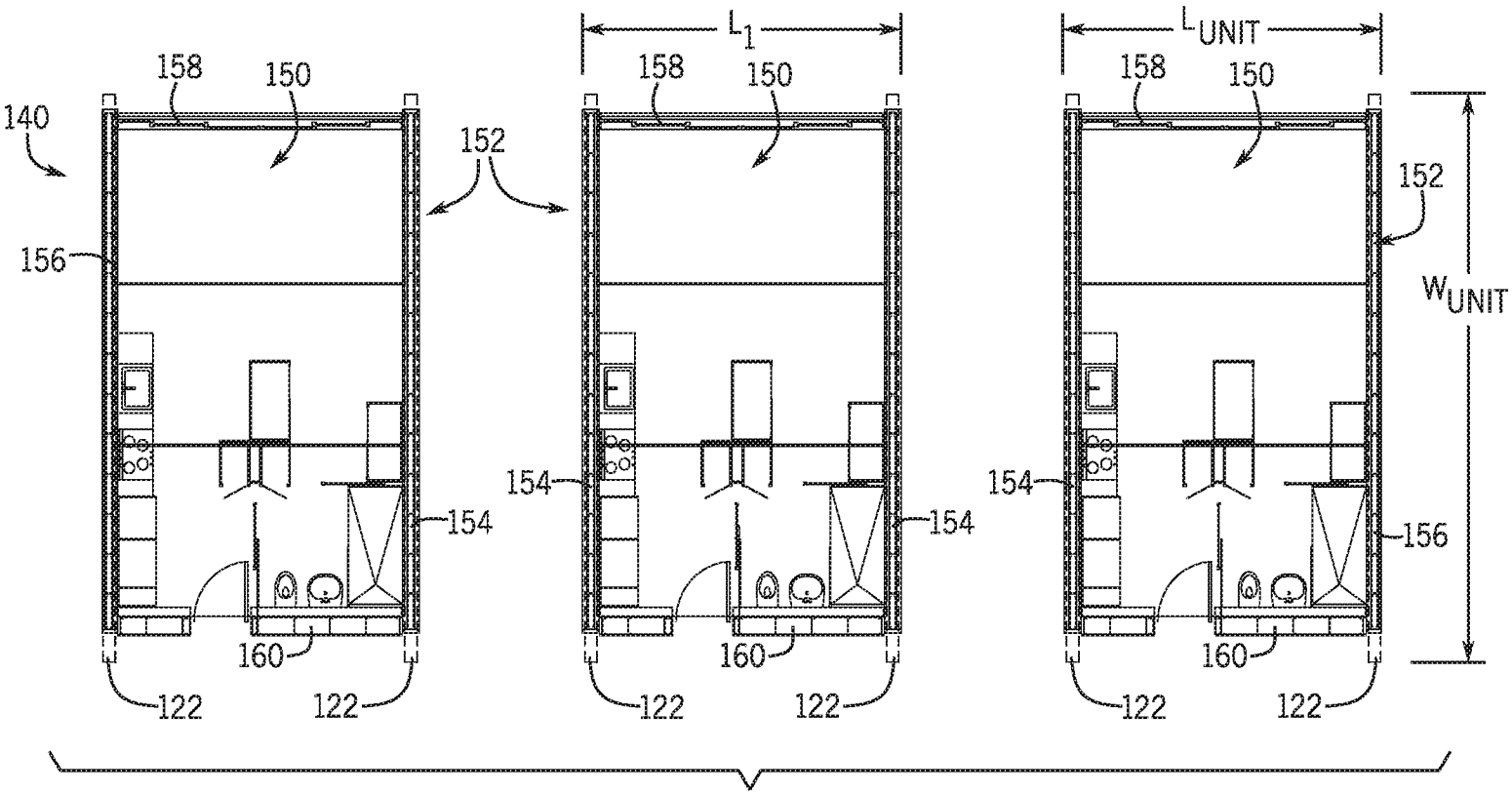
FIG. 2 is a schematic illustration of example floor plans of a plurality of building units assembled from prefabricated components.
Figure 3:
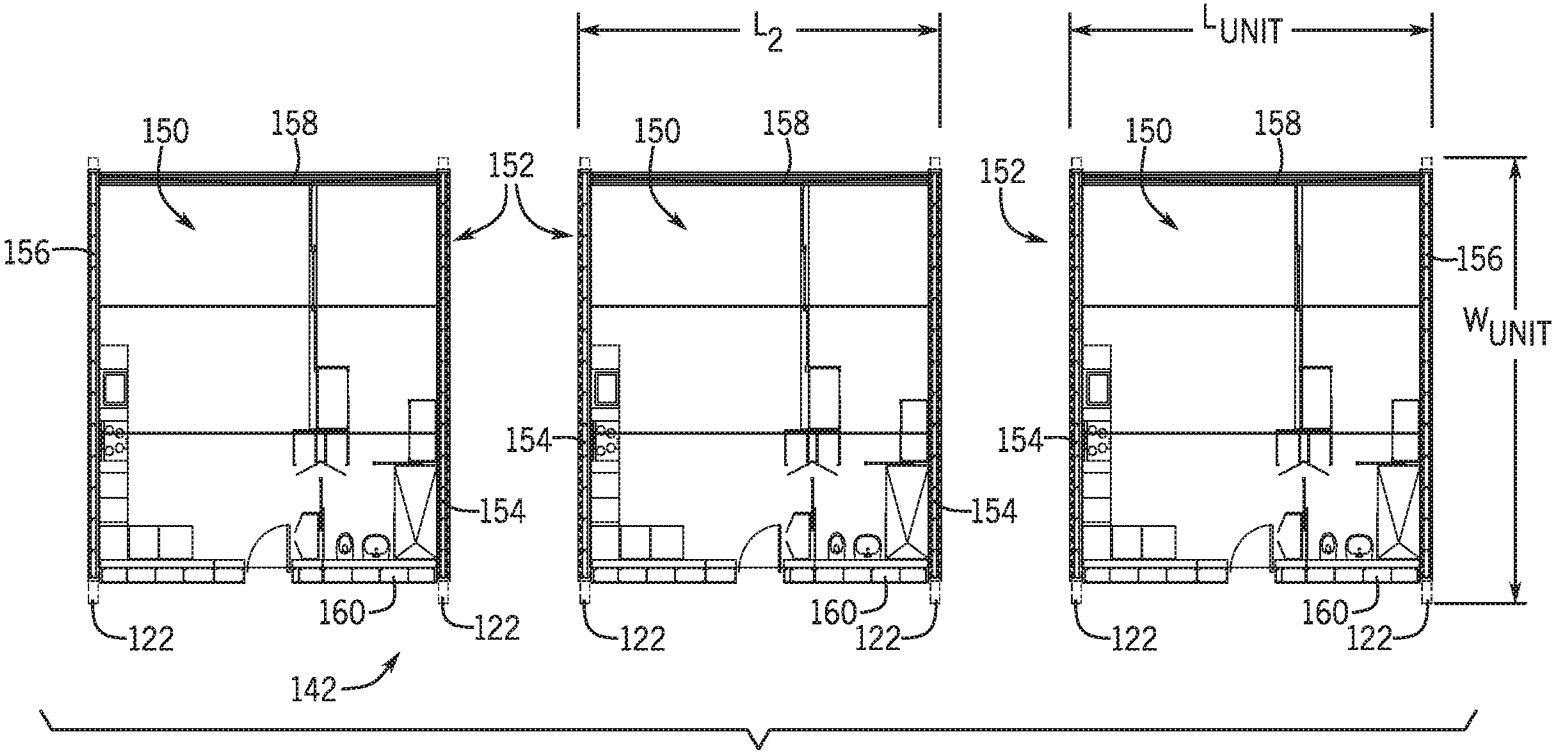
FIG. 3 is a another schematic illustration of example floor plans of a plurality of building units assembled from prefabricated components.
Figure 4:
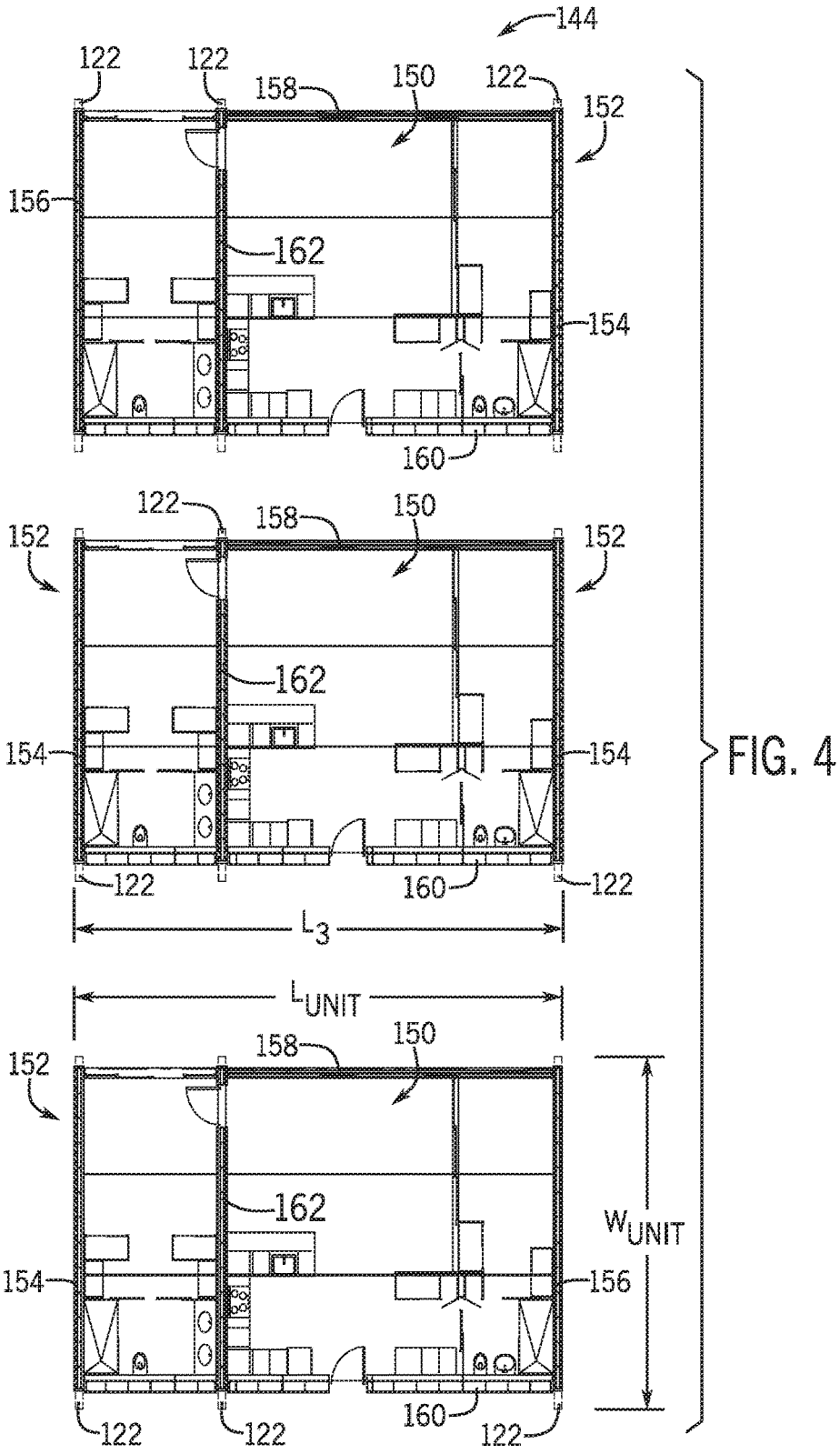
FIG. 4 is a another schematic illustration of example floor plans of a plurality of building units assembled from prefabricated components.
Figure 5:
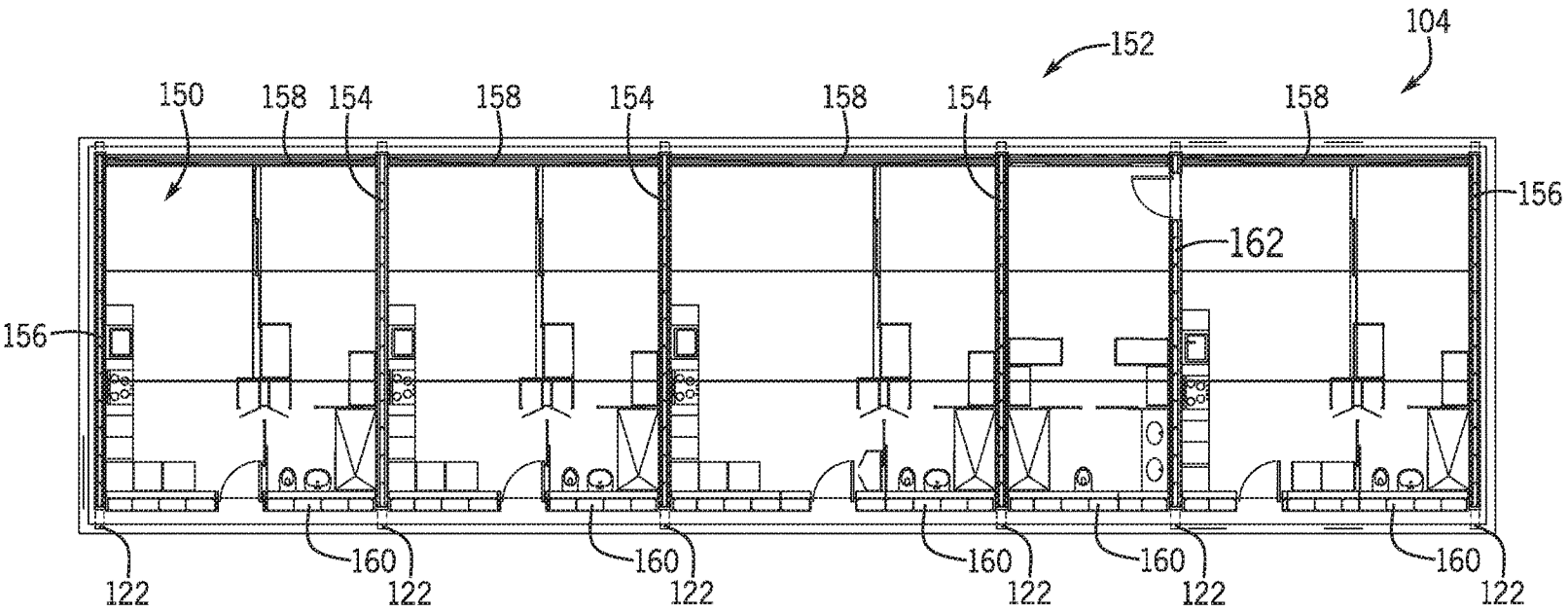
FIG. 5 is a schematic illustration of an example building story floor plan.

FIGS. 2-5 illustrate example floor plans of the building 100 assembled from prefabricated components 106. FIG. 2 shows floor plans of a first plurality of building units 140 according to some examples herein. FIG. 3 shows floor plans of a second plurality of building units 142 according to some examples herein. FIG. 4 shows floor plans of a third plurality of building units 144 according to some examples herein. FIG. 5 shows a floor plan of a story 104 of the building 100 according to some examples herein. In the examples of FIGS. 2-4, the first plurality of building units 140 may each be a studio residence, the second plurality of building units 142 may each be a one-bedroom residence, and the third plurality of building units 144 may each be a two-bedroom residence.

Each building unit 110 has a unit width $W_{Unit}$ and a unit length $L_{Unit}$ extending along the building's width W and length L, respectively. In at least one example, a studio residence may have a first length $L_1$, a one-bedroom residence may have a second length $L_2$, and a 2-bedroom residence may have a third length $L_3$. The third length $L_3$ may be greater than the second length $L_2$. The second length $L_2$ may be greater than the first length $L_1$. The unit width $W_{Unit}$ of each building unit 110 may be arranged depending on the particular building arrangement. For example, each building unit 110 on the same story 104 may have the same unit width $W_{Unit}$. In some examples, each building unit 110 in the building 100 may have the same unit width $W_{Unit}$.

Depending on the particular application, each story 104 of the building 100 may include building units 110 assembled in accordance with the various floor plans of one or more of the first, second, and third pluralities of building units 140, 142, 144. For example, each story 104 of the building 100 may be assembled to include any combination of studio, one-bedroom, and two-bedroom residences. For example, as shown in FIG. 5, at least one story 104 of the building 100 may include a one-bedroom residence (e.g., three one-bedroom residences) and a two-bedroom residence (e.g., one two-bedroom residence). FIG. 5 is illustrative only and other combinations are contemplated.

Each floor plan includes a plurality of prefabricated floor panels 150 and a plurality of prefabricated walls 152 (such as any suitable combination of prefabricated demising walls 154, end walls 156, window walls 158, utility walls 160, and bedroom walls 162, as explained below). Each floor plan is designed to provide a desired characteristic of the respective building unit 110. For example, each floor plan may be designed to provide the unit width $W_{Unit}$, the unit length $L_{Unit}$, and/or a desired look and feel (e.g., flow) of the building unit 110, among others. The various components and floor plans shown in FIGS. 2-5 are merely illustrative, and other variations, such as eliminating components, combining components, and substituting components, are contemplated. To that end, one of ordinary skill in the art would appreciate that FIGS. 2-5 in no way represent all possible permutations of floor panels and walls to define a building unit nor all permutations of building units to define a story of a building.

As described herein, the prefabricated walls 152 may include walls that partition the building 100 into the various building units 110, walls that partition the interior of each building unit 110 into two or more rooms, walls that include utility components, walls that include window components, walls that define terminal ends of the building 100, and others. Walls that define partitions between building units 110 may be referred to as demising walls (e.g., demising wall 154). Walls that define partitions between rooms within a single building unit 110 may be referred to as bedroom walls (e.g., bedroom wall 162). In a preferred example, the demising and bedroom walls 154, 162 are internal walls positioned within the envelope of the building 100 such that the walls are not exposed to the elements. In similar fashion, walls that include utility components may be referred to as utility walls (e.g., utility wall 160), walls that include window components, such as one or more windows, may be referred to as window walls (e.g., window wall 158), and walls that define the terminal ends of the building 100 may be referred to as end walls (e.g., end wall 156). In such examples, the utility and window walls 160, 158 may define the terminal sides of the building 100. In some examples, the utility walls 160, window walls 158, and/or end walls 156 may be positioned around at least a portion of the perimeter of the building 100 to at least partially define the envelope of the building 100. In some examples, each wall may be prefabricated for a single purpose. For instance, the utility components (e.g., plumbing, sewer, electrical, etc.) of the building 100 may run through only the utility walls 160, the window components of the building 100 may be arranged within only the window walls 158, and so on. As further example, the end walls 156 may be prefabricated to enclose only the opposite ends of the building 100 to define the length L of the building 100. In such examples, the utility walls 160 and the window walls 158 may be prefabricated to enclose the opposite sides of the building 100 to define the building's width W.

The prefabricated floor panels 150 and the prefabricated walls 152 (e.g., the prefabricated demising walls 154, bedroom walls 162, utility walls 160, and/or end walls 156) may be configured to reduce the overall number of separate parts delivered to the jobsite as may be required to construct the floor and wall systems of the building 100. For example, the floor panels 150 include all components or substantially all of the components (e.g., except finished floor surfaces, including the finished floor surfaces, etc.) for a floor system of the building 100. In like manner, the prefabricated walls 152 (e.g. the prefabricated demising walls 154, bedroom walls 162, utility walls 160, and/or end walls 156) may include most or all of the components (e.g., except finished wall surfaces, including finished wall surfaces, etc.) for a wall system of the building 100. According to some examples herein, the floor panels 150 may be sized such that they span a portion or a full length L of a building unit 110, such as a full length between opposite walls of the building unit 110, which in some cases may correspond to the opposite exterior walls of the building 100. In some examples, the floor panels 150 may be sized such that two or more floor panels 150 (e.g., two floor panels 150, three floor panels 150, six floor panels 150, etc.) are joined together to form the floor system of an entire building unit 110 and/or story 104 of the building 100. For example, two or more floor panels 150 may be joined side-to-side to define one of the dimensions of the building unit 110 (e.g., the unit width $W_{Unit}$) while the other dimension may be defined by the length of one or more floor panels 150 connected on end.

FIGS. 6-9 illustrate example prefabricated floor panels 150 and prefabricated walls 152 according to various examples of the present disclosure. In typical multi-story building construction, steel framing is used in conjunction with concrete for constructing the wall system and/or the floor system of the building. Concrete slabs may slow the construction process as individual concrete slabs are poured and cured in situ at each level or story as each new level or story of the building is added. Temporary formwork for the concrete slab is installed at each level and the construction crew must wait for the concrete to cure prior to removal of the temporary formwork and completion of other elements (e.g., exterior and interior walls, window installation, various interiors elements including plumbing, mechanical, and electrical systems and finishes), which may significantly increase construction timeline and cost. Pre-cast concrete slabs may be used instead of casting the slabs in situ. However, there may be some limitations to using pre-cast slabs such as the weight of the slabs themselves and the associated difficulty in transporting and installing such pre-cast slabs. Also, stricter dimensional tolerances for the pre-cast slabs and building frame construction may need to be followed to ensure the slabs can be installed to the building frame. In addition, building construction using concrete slab construction tend to be significantly heavier and costlier. For example, a floor system with a concrete slab may weigh between about 50 lb/ft$^2$ and about 100 lb/ft$^2$, and may cost about \$40/ft$^2$.

On the other hand, the present disclosure describes prefabricated components and methods for building construction and specifically for constructing a building 100 using prefabricated walls and floor panels, and without the use of onsite floor and wall construction. In one example, floor systems implementing the examples herein may weigh and cost significantly less, such as weighing about 10 lb/ft$^2$ and costing about \$10/ft$^2$. In addition, floor systems implementing the examples herein may be significantly faster to construct compared to conventional slab construction. Similar results may be achieved implementing the prefabricated wall systems described herein.

Figure 6:
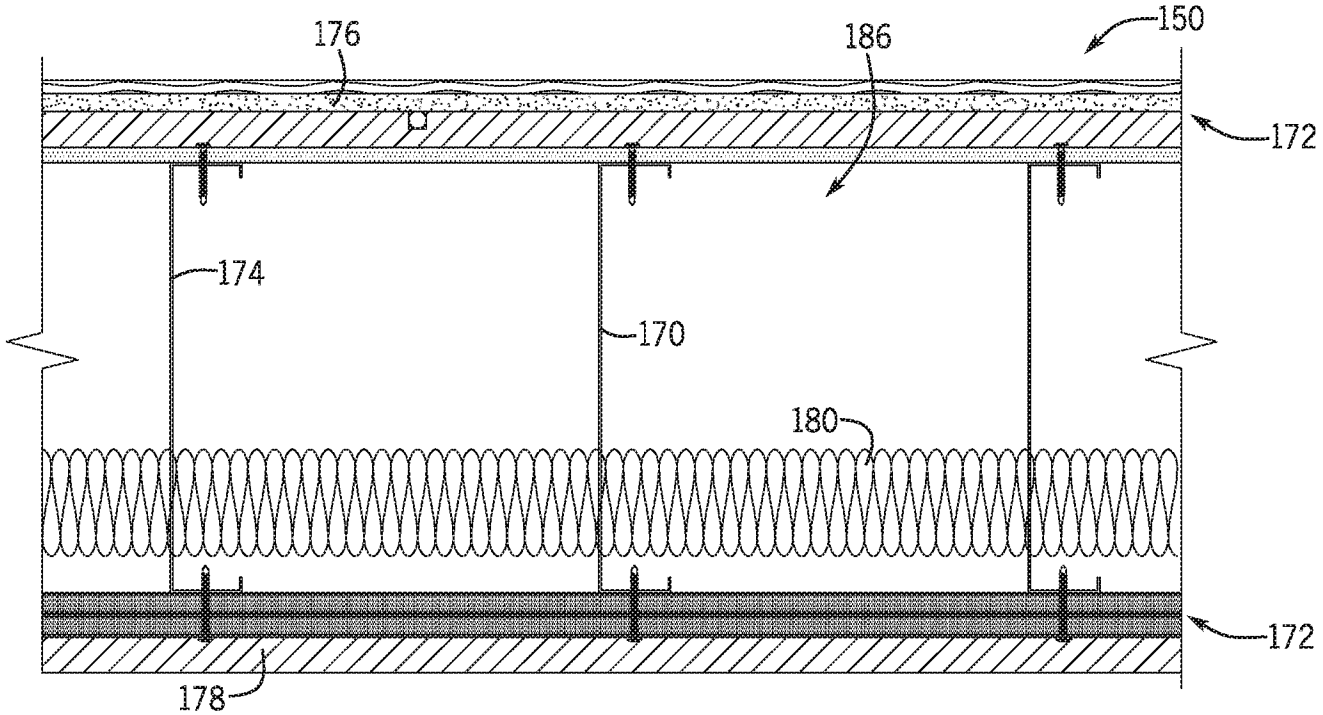
FIG. 6 is a partial cross-sectional view of a prefabricated floor panel according to one example.

The floor panels 150 may be prefabricated in any suitable manner. As one example, FIG. 6 illustrates a floor panel 150 according to one embodiment of the present disclosure. According to various examples herein, each floor panel 150 includes a frame 170 and outer layers 172 attached to the frame 170, such as to opposite sides of the frame 170 (see FIG. 6). The outer layers 172 may be attached to the frame 170 in any suitable manner, such as by adhesive, fasteners, corresponding retention features, or any combination thereof. In one embodiment, each floor panel 150 includes connection structures configured to couple the floor panels 150 to the structural frame 102, such as to the beams 122, and/or to one or more walls. As shown in FIG. 6, the frame 170 may be defined by a plurality of joists 174 in spaced arrangement between opposite ends of the floor panel 150. As an example of an outer layer 172, a floor structure 176 may be disposed over and attached to the frame 170, such as attached to a top side of the frame 170. As an additional or alternative example of an outer layer 172, a ceiling structure 178 may be disposed below and attached to the frame 170, such as attached to a bottom side of the frame 170. In such embodiments, the floor structure 176 may support a floor material (e.g., a floor finish) of an upper story, and the ceiling structure 178 may support a ceiling material (e.g., a ceiling finish) of a lower story. Each of the floor and ceiling structures 176, 178 may include one or more stacked layers of boards, such as drywall, particle board, OSB, or the like. As shown in FIG. 6, an insulative material 180 (e.g., mineral wool batt insulation) may be positioned between the floor and ceiling structures 176, 178, such as within the frame 170.

Each floor panel 150 may take on any suitable shape or configuration. For instance, and without limitation, each floor panel 150 may be quadrilateral in shape and may include opposite ends 182 and opposite sides 184 extending between the opposite ends 190 (see FIG. 10). In such embodiments, the opposite ends 182 may define the length of the floor panel 150, and the opposite sides 184 may define the width of the floor panel 150. In a preferred example, the opposite sides 184 are longer than the opposite ends 182 such that each floor panel 150 includes a rectangular shape. As explained more fully below, at least one of the opposite ends 182 and opposite sides 184 may include connection structures operable to couple each floor panel 150 to other structure, such as to the structural frame 102 (e.g., to the floor beams 122) and/or to other prefabricated components 106 (e.g., to the prefabricated walls 152 and/or to adjacent floor panels 150).

Each floor panel 150 may be operable to carry loads (e.g., diaphragm loads) to the structural frame 102. For example, to provide structural rigidity and strength to the floor panels 150, the joists 174 may extending between the opposite ends 182 of the floor panel 150 and in spaced arrangement along the width of the floor panel 150 (such as equidistantly spaced between the opposite sides 184 of the floor panel 150). In such embodiments, the joists 174 may define supporting members that span between the opposite ends 182 of the floor panel 150 to support the floor and ceiling layers 176, 178 of the floor panel 150. For instance, each of the floor and ceiling structures 176, 178 of the floor panel 150 may be attached to the joists 174 (e.g., via adhesive, fasteners, or the like). The joists 174 may be arranged generally parallel to one another, such as along the length of the floor panel 150. In some examples, the joists 174 may be spaced at regular intervals along the width of the floor panel 150 (e.g., on 6 inch centers, on 12 inch centers, on 16 inch centers, on 36 inch centers, etc.) to define a joist cavity 186 between adjacent joists 194. In such embodiments, the joist cavities 186 may accommodate plumbing, wiring, HVAC ductwork, or other elements that support dwelling or commercial activities in the building 100. For example, the insulative material 180 may be positioned within the joist cavities 186 to provide a degree of thermal insulation and/or sound deadening quality to the floor panel 150.

Each floor panel 150 may be fabricated using discrete (e.g., separable) pre-manufactured construction elements (e.g., boards, studs, paneling, etc.), which may be fabricated offsite, such as in a factory or other location remote from the construction site. According to the present disclosure, each floor panel 150 is prefabricated (e.g., in a factory) and delivered to the construction site for installation as part of the building 100. Each floor panel 150 may be formed of any suitable material. For example, the frame 170 may be formed from metal, such as aluminum or steel. In some embodiments, the frame 170 may be formed of a non-metallic material, such as wood, plastic, fiber reinforced composites, or other material. In the illustrated example of FIG. 6, the joists 194 are formed of metal and have a C-shaped cross-section, though the joists 194 may include substantially any cross-sectional shape (e.g., I-beams, etc.).

The frame 170 may be arranged to suit the particular needs of a building project. For instance, the number of joists 174, the spacing of the joists 174, the length of the joists 174 (which also defines the length of the floor panel 150), and/or the lengths of the opposite ends 182 of the floor panel 150 may be selected based on the load and/or dimensional requirements of the floor panel 150. For example, a higher load requirement may require a greater number of joists 174, and vice-versa. Similarly, a wider floor panel 150 may require a greater number of joists 174, and vice-versa. Accordingly, the specific configuration illustrated in FIG. 6 is provided for illustration purposes only, and the floor panel 150 (e.g., the frame 170) may be arranged differently than specifically illustrated.

Figure 7:
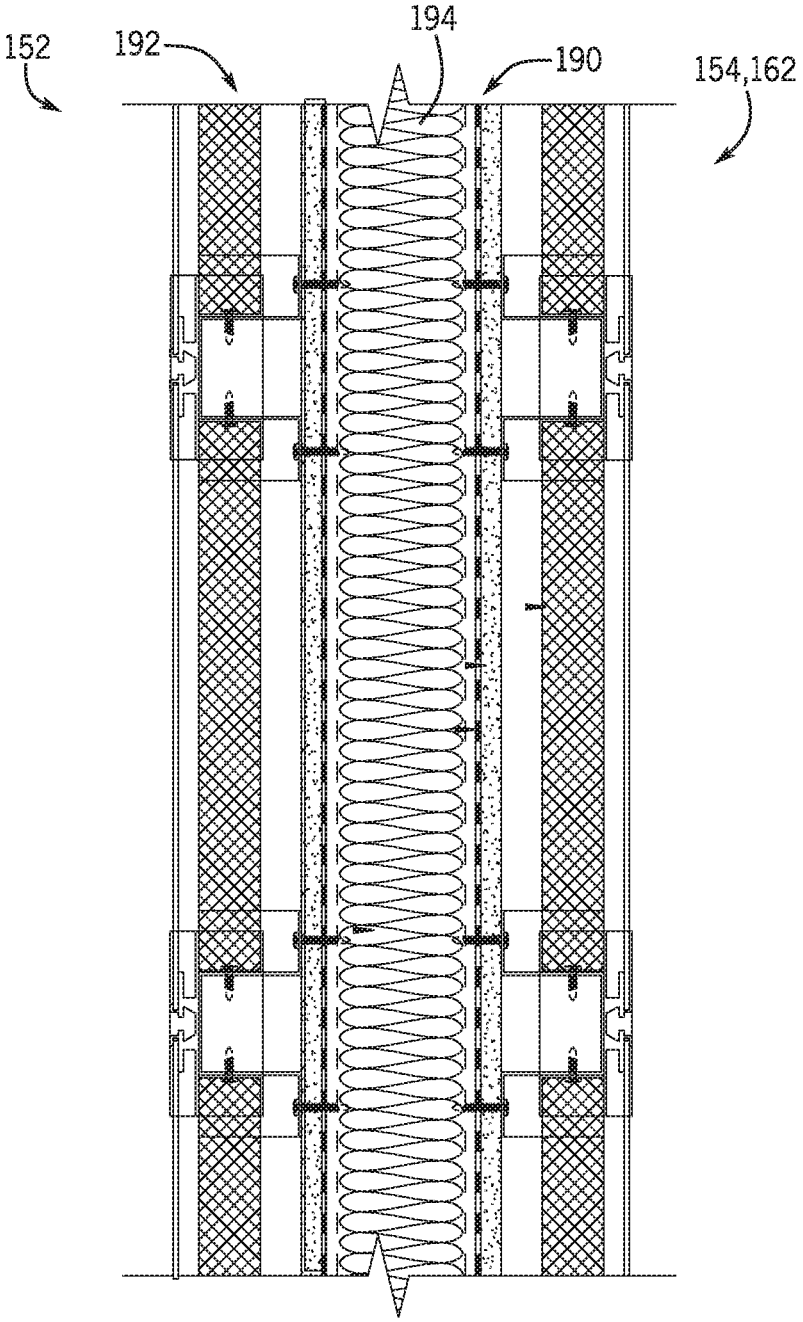
FIG. 7 is a partial cross-sectional view of a prefabricated demising wall according to one example.
Figure 8:
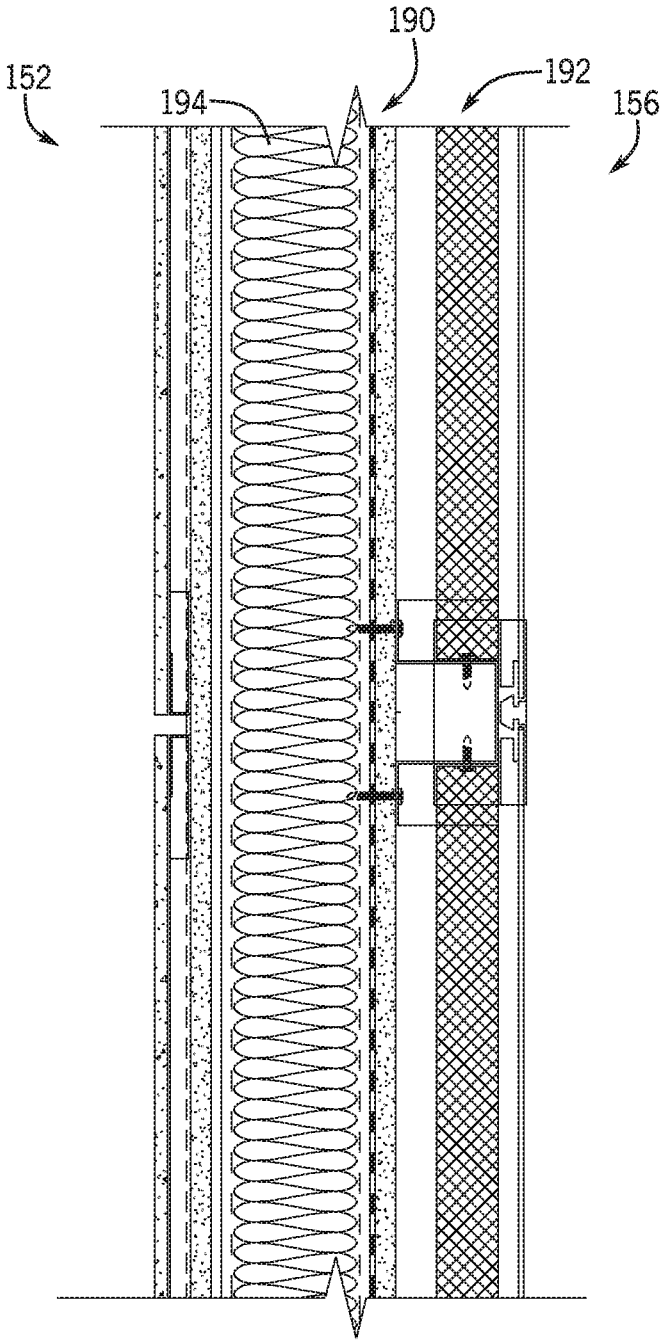
FIG. 8 is a partial cross-sectional view of a prefabricated end wall according to one example.
Figure 9:
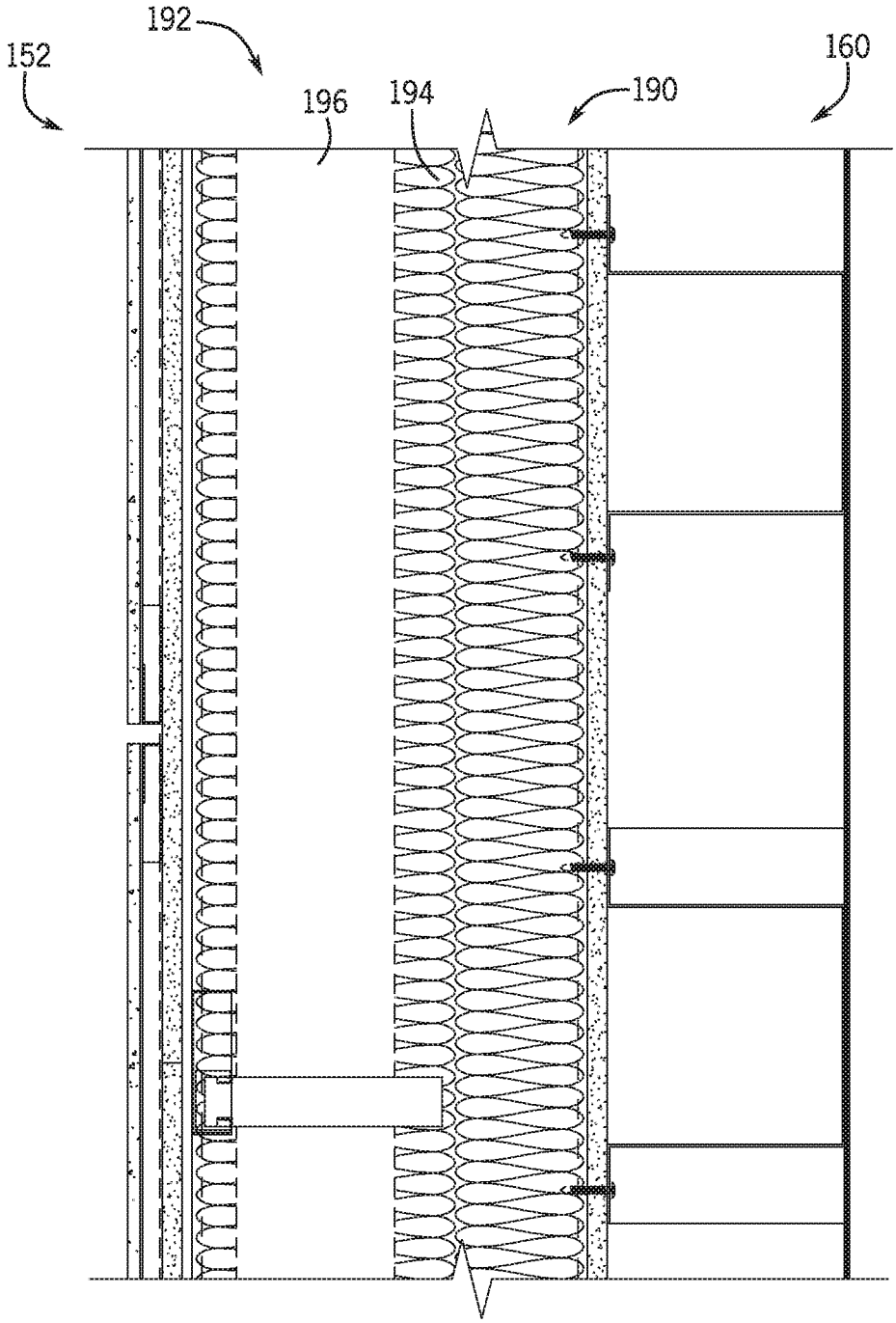
FIG. 9 is a partial cross-sectional view of a prefabricated utility wall according to one example.

FIGS. 7-9 illustrate example prefabricated walls 152, such as an example demising wall 154 (see FIG. 7), an example end wall 156 (see FIG. 8), and an example utility wall 160 (see FIG. 9), according to the present disclosure. The bedroom walls 162 may be configured similar to the demising walls 154. Each prefabricated wall 152 may be configured (and prefabricated) similar to the floor panels 150 and/or similar to one another. As such, like features will not be discussed when they would be apparent to one of ordinary skill in the art in light of the description above and in view of FIGS. 7-9.

As shown, each demising wall 154, bedroom wall 162, utility wall 160, and end wall 156 may include a frame 190 operable to carry loads to the structural frame 102, and one or more outer layers 192 attached to the frame 190 to provide a desired aesthetic and/or functional characteristic. For instance, the outer layers 192 may be attached to the frame 190 such that the frame 190 is positioned at least partially between the outer layers 192. In one example, the outer layers 192 of each prefabricated wall 152 may provide an attachment point to which to install various interior and/or exterior finishes of the building 100 (e.g., interior drywall, exterior paneling or siding, etc.). Each prefabricated wall 152 may also include an insulative material 194 (e.g., mineral wool batt insulation) positioned between the outer layers 192, such as within the frame 190. Similar to the floor panels 150, each prefabricated wall 152 may include connection structures configured to couple the walls 152 to the structural frame 102 (such as to the columns 120 and/or to the beams 122) and/or to an adjacent floor panel. As shown in FIG. 9, each utility wall 160 may include pluming component 196 (e.g., piping) to supply water to the building unit 110 as well as to provide drainage of sewer water and greywater.

Figure 10:
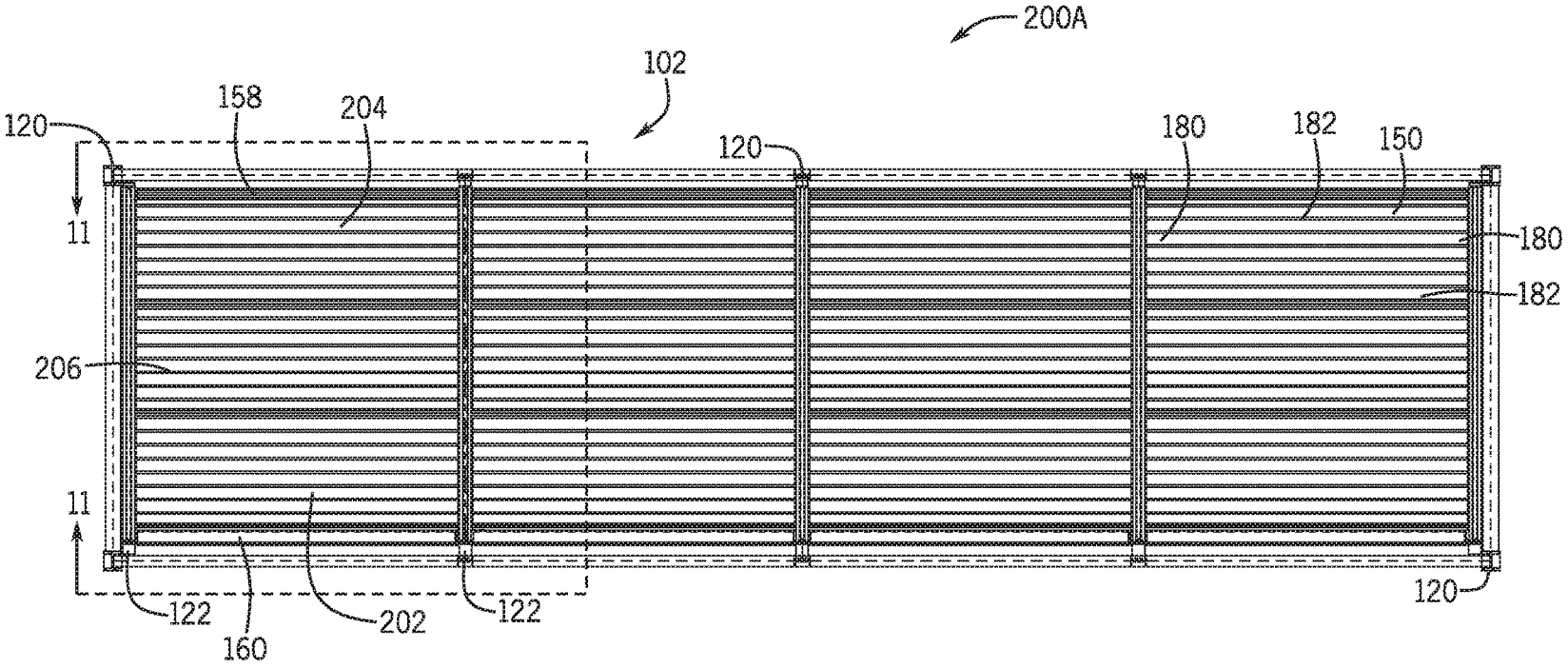
FIGS. 10-12A are schematic illustrations of example floor systems of a building unit assembled from a plurality of prefabricated floor panels.
Figure 11:
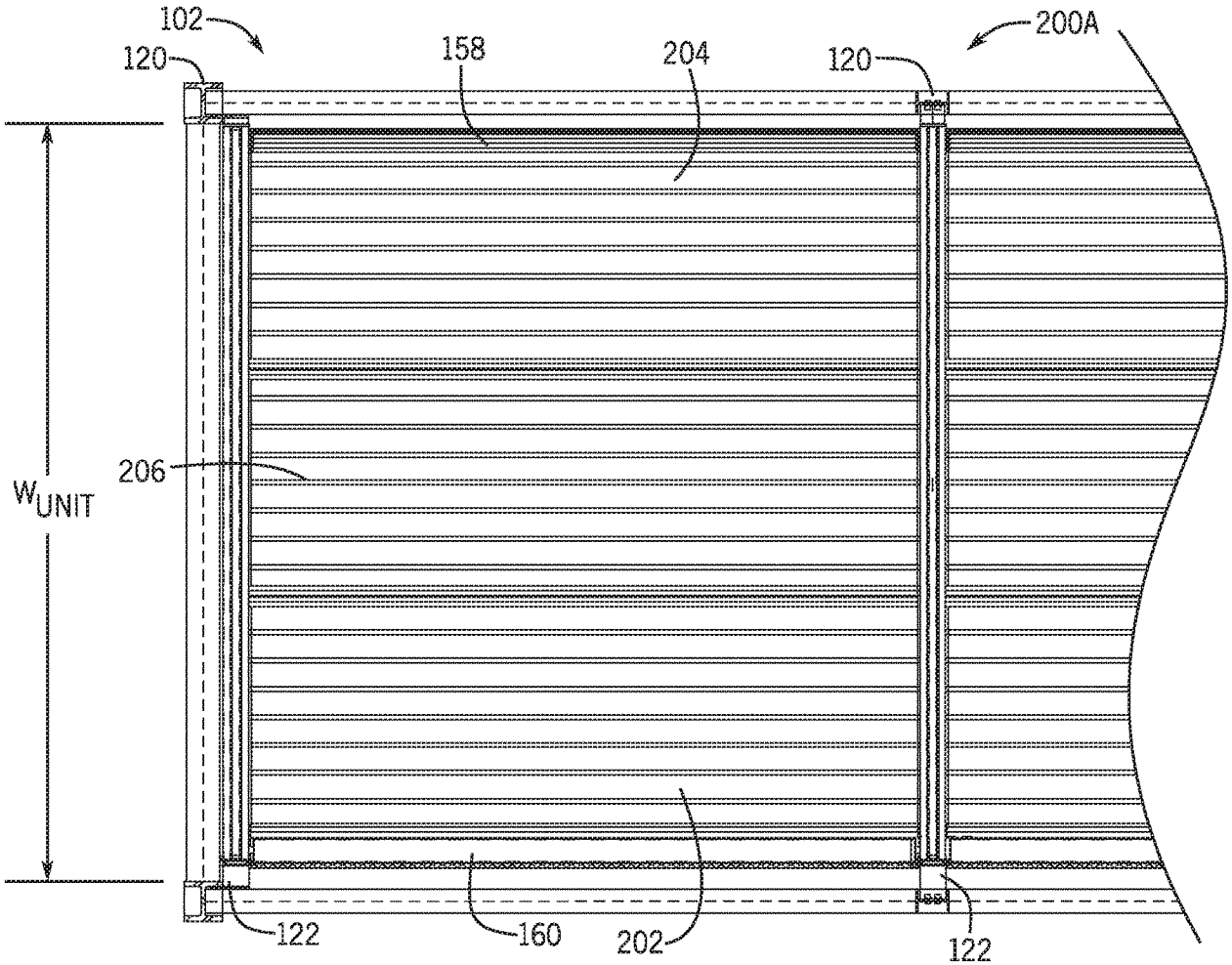
Figure 11A:
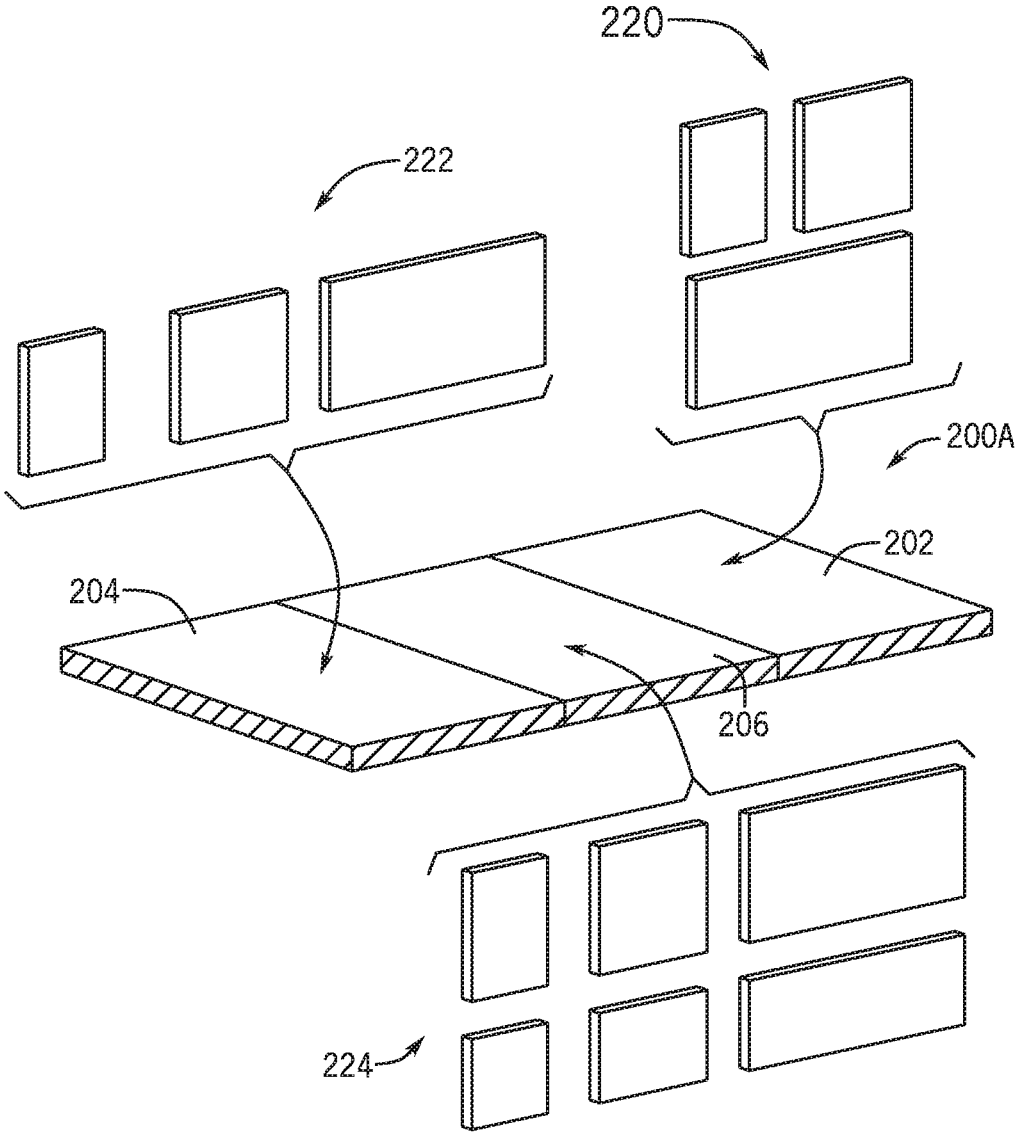
Figure 12:
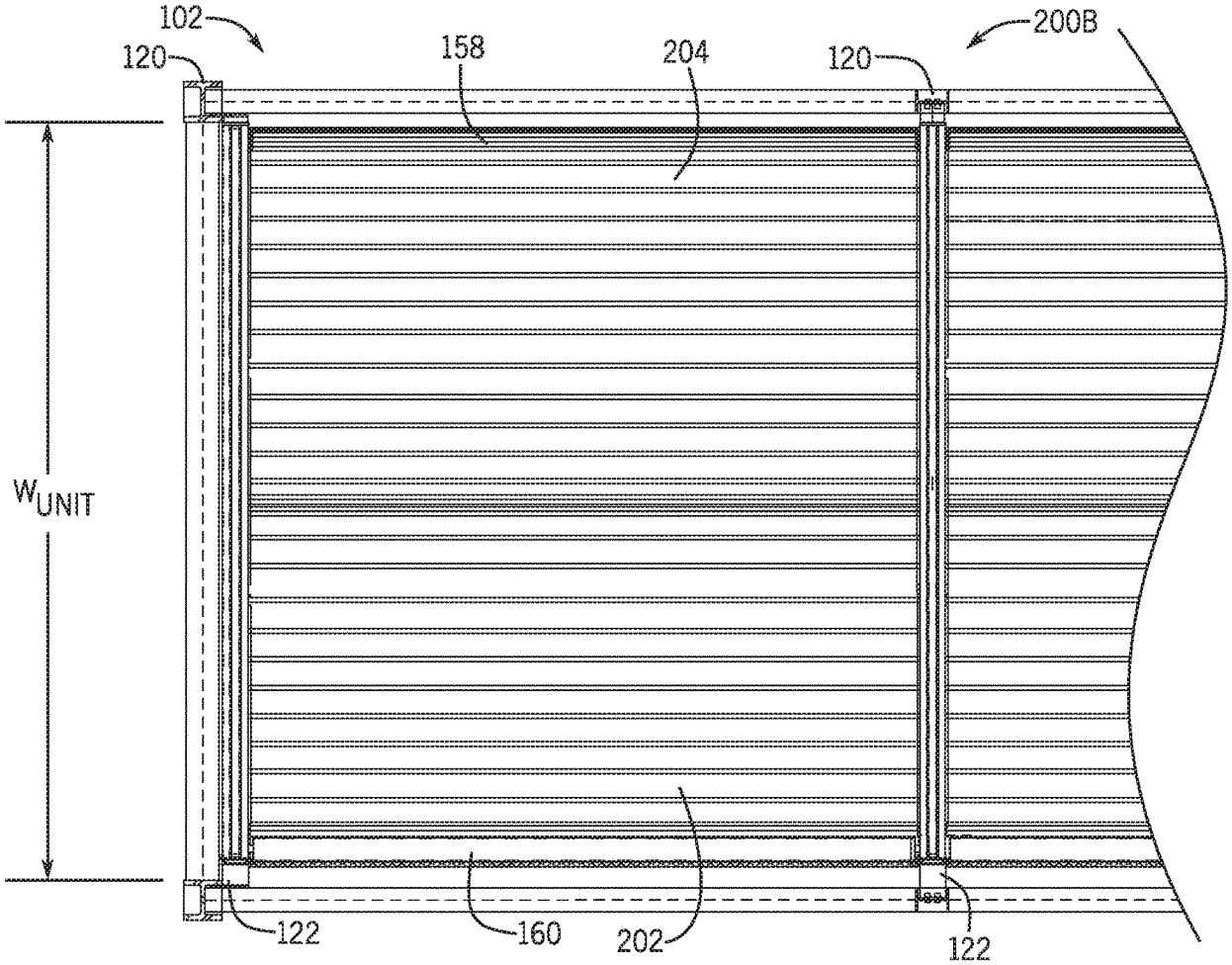
Figure 12A:
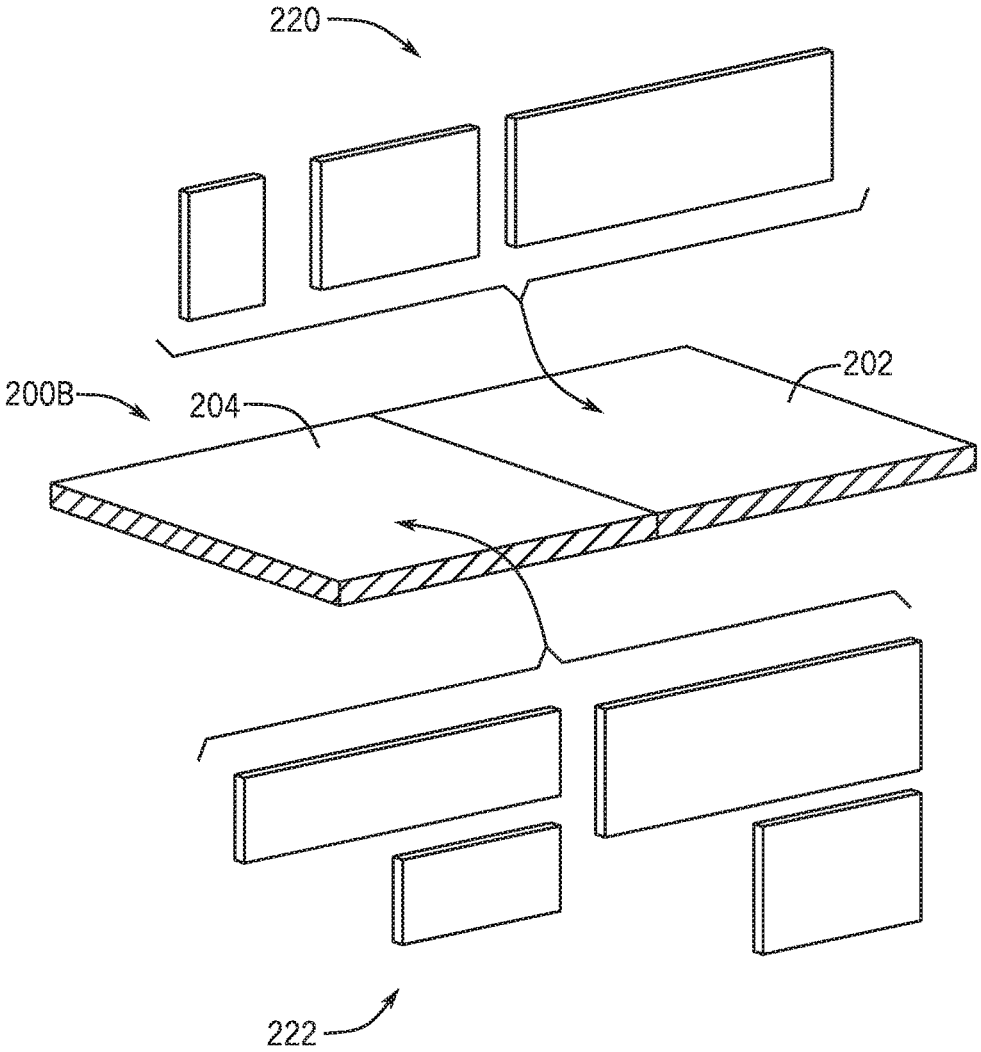

FIGS. 10-11A illustrate a floor system 200A of a building 100 assembled from a plurality of prefabricated floor panels 150 in accordance with a floor plan. FIGS. 12 and 12A illustrate another floor system 200B of a building 100 assembled from a plurality of prefabricated floor panels 150 in accordance with a floor plan. As shown in FIGS. 10-12A, the floor systems 200A, 200B are assembled (in accordance with a floor plan as outlined above) using a first prefabricated floor panel 202 and a second prefabricated floor panel 204 (see FIGS. 12 and 12A), and in some embodiments using an additional third prefabricated floor panel 206 (see FIGS. 10-11A). Depending on the particular application, additional floor panels 150 may be installed (such as additional three floor panels 150, such as in two-bedroom residences). As described herein, the first, second, and third floor panels 202, 204, 206 may be configured to be installed in respective first, second, and third positions of the building unit 110. For instance, the first floor panel 202 may be configured to be installed in a first position of the building unit 110, which may be adjacent the utility wall 160 of the building unit 110. Similarly, the second floor panel 204 may be configured to be installed in a second position of the building unit 110, which may be adjacent the window wall 158 of the building unit 110. In such embodiments, the third floor panel 206 may be configured to be installed in a third position of the building unit 110, which may be between the first and second floor panels 202, 204.

To aid construction efficiency, in some embodiments, illustrated in FIGS. 11A and 12A, the first floor panel 202 may be selected from a first plurality of prefabricated floor panels 220. Similarly, the second floor panel 204 may be selected from a second plurality of prefabricated floor panels 222, and the third floor panel 206 may be selected from a third plurality of prefabricated floor panels 224. As described herein, the first plurality of prefabricated floor panels 220 has a same first width. As such, the first plurality of prefabricated floor panels 220 may differ from one another only in length such that the first plurality of prefabricated floor panels 220 is considered to have a variable length. In this manner, the first plurality of prefabricated floor panels 220 may accommodate the lengths of the various building unit floor plans.

The second plurality of prefabricated floor panels 222 may be configured similarly. Namely, the second plurality of prefabricated floor panels 222 may have a same second width, which may be equal to the first width of the first plurality of prefabricated floor panels 220 depending on the application. As such, the second plurality of prefabricated floor panels 222 may differ from one another only in length such that the second plurality of prefabricated floor panels 222 is considered to have a variable length.

The third plurality of prefabricated floor panels 224 may be configured differently than the first and second pluralities of prefabricated floor panels 220, 222. For example, rather than having the same width, the floor panels in the third plurality of prefabricated floor panels 224 may have different widths. In such embodiments, the third floor panel 206 may be selected such that a sum of the widths of the first, second, and third floor panels 202, 204, 206 corresponds to the total width of the building unit 110 (e.g., the unit width $W_{Unit}$) in accordance with a floor plan. Depending on the particular application, the widths of the first and second floor panels 202, 204 may be greater than the width of the selected third floor panel 206. In some embodiments, the widths of the first and second pluralities of prefabricated floor panels 220, 222 may be greater than the widths of the third plurality of prefabricated floor panels 224

Like the first and second pluralities of prefabricated floor panels 220, 222, the third plurality of prefabricated floor panels 224 may differ from one another in length such that the third plurality of prefabricated floor panels 224 is considered to have a variable length. In such embodiments, the first, second, and third floor panels 202, 204, 206 may be selected to have the same length (such as the unit length $L_{Unit}$ of the building unit 110). In at least one example, the lengths of the first, second, and third floor panels 202, 204, 206 may be selected to achieve a desired total length of the building unit 110, whether in combination with adjacent floor panels (see FIG. 4) or alone (see FIGS. 2 and 3).

The first, second, and third floor panels 202, 204, 206 are named as such for convenience only. Thus, the second floor panel 204 may be referred to alternatively as the third floor panel 206, and the third floor panel 206 may be referred to alternatively as the second floor panel 204, among others. In such embodiments, the floor system 200A, 200B of the building unit 110 may be assembled by installing first and second prefabricated floor panels (e.g., the first floor panel 202 and the third floor panel 206) in respective positions (see FIG. 11). In such embodiments, the second floor panel 204 may be selected from a plurality of floor panels each having a different width. In such embodiments, the width of the second floor panel 204 may be selected such that the sum of the width of the first floor panel 202 and the width of the second floor panel 204 corresponds to a unit width $W_{Unit}$ of the building unit 110 in accordance with a floor plan. In one example, a third floor panel 206 (e.g., the second floor panel 204) may be installed according to a floor plan, such as adjacent the second floor panel 204 such that the second floor panel 204 is positioned between the first and third floor panels 202, 206. In such embodiments, the width of the third floor panel 206 may be equal to the width of the first floor panel 202.

The first, second, and third floor panels 202, 204, 206 may be installed in any suitable manner. For example, the first, second, and third floor panels 202, 204, 206 may be attached or otherwise coupled to the structural frame 102 (e.g., to the beams 122 of the structural frame 102). According to at least one example of the present disclosure, the first, second, and third floor panels 202, 204, 206 may be installed to and between adjacent beams 122 in a manner to support anticipated loads thereon (e.g., building occupants, furniture, furnishings, etc.). For example, the connection structures of the first, second, and third floor panels 202, 204, 206 may facilitate the ends of the floor panels to be attached or otherwise coupled to adjacent beams 122, such as by welding, bolting, interlocking structural features or other suitable manner.

Figure 13:
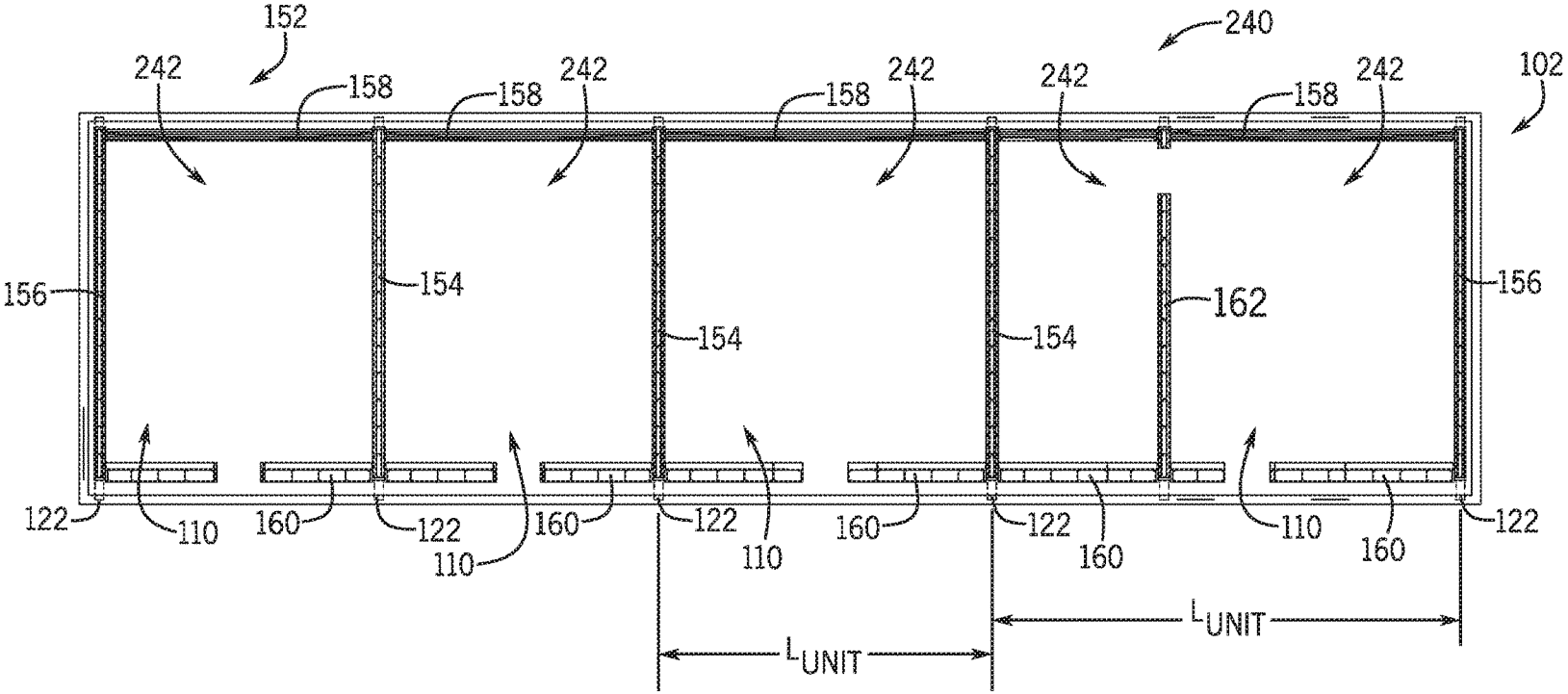
FIGS. 13-13A are schematic illustrations of example wall systems of a building unit assembled from a plurality of prefabricated walls.
Figure 13A:
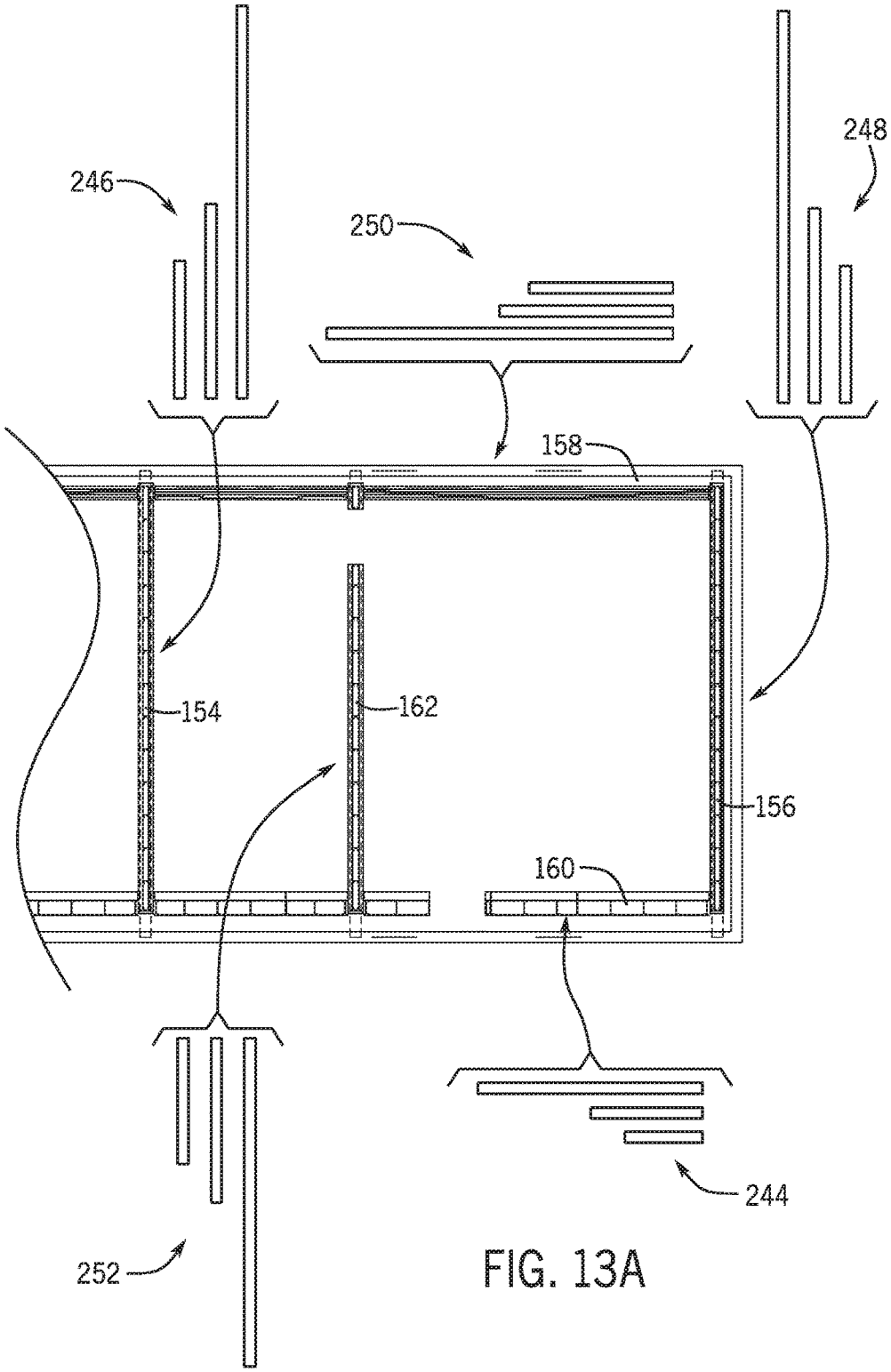

FIGS. 13 and 13A illustrate a wall system 240 of a building 100 assembled from a plurality of prefabricated walls 152 in accordance with a floor plan. As described herein, the wall system 240 is assembled in accordance with a floor plan using two or more prefabricated walls 152. The plurality of prefabricated walls 152 may be installed to define one or more interior rooms 242 of each building unit 110. For example, the plurality of prefabricated walls 152 may be installed to define a building unit 110 having one interior room 242, two interior rooms 242, three interior rooms 242, and the like. The floor plan may define the interior rooms 242 as a bedroom, a bathroom, a living room, a kitchen, or the like. In one example, each building unit 110 consisting of one interior room may be considered a studio residence, each building unit 110 consisting of two interior rooms 242 may be considered a one-bedroom residence, each building unit 110 consisting of three interior rooms 242 may be considered a two-bedroom residence, and so forth, though any suitable combination of bedrooms and other living spaces is contemplated.

In accordance with various examples of the present disclosure, the prefabricated walls 152 may be configured to be installed in interchangeable positions or may be configured to be installed in specific locations. For instance, and without limitation, the plurality of prefabricated walls 152 may include one or more prefabricated utility walls (e.g., utility wall 160) arranged to provide utilities (e.g., water, sewer, electrical, etc.) to each building unit 110, one or more prefabricated demising walls (e.g., demising wall 154) arranged to partition each story 104 into two or more building units 110, one or more window walls (e.g., window wall 158) arranged to define a terminal side of each story 104 of the building 100, one or more prefabricated end walls (e.g., end wall 156) arranged to define the terminal ends of each story 104 of the building 100, one or more prefabricated bedroom walls (e.g., bedroom wall 162) arranged to partition a building unit 110 into two or more interior rooms 242, or any combination thereof. In such embodiments, the utility, demising, window, end, and bedroom walls 160, 154, 158, 156, 162 may be installed interchangeably within various building units 110. For example, and without limitation, the demising wall 154 of one building unit 110 may be used interchangeably for the demising wall 154 of another building unit 110. In some embodiments, the utility, demising, window, end, and bedroom walls 160, 154, 158, 156, 162 may be configured to be installed in particular building units 110 in accordance with a floor plan.

As one example, as illustrated in FIG. 13A, the utility wall 160 may be selected from a plurality of prefabricated utility walls 244. The demising wall 154 may be selected from a plurality of prefabricated demising walls 246. The end wall 156 may be selected from a plurality of prefabricated end walls 248. The window wall 158 may be selected from a plurality of prefabricated window walls 250. Similarly, the bedroom wall 162 may be selected from a plurality of prefabricated bedroom walls 252. The plurality of prefabricated utility walls 244 may differ from one another only in length such that the plurality of prefabricated utility walls 244 is considered to have a variable length. As such, the plurality of prefabricated utility walls 244 may accommodate the lengths of the various building unit floor plans. For example, one building unit 110 may have a relatively shorter unit length $L_{Unit}$ requiring a relatively shorter utility wall 160 in length. Similarly, another building unit 110 may have a relatively longer unit length $L_{Unit}$ requiring a relatively longer utility wall 160 in length. The plurality of window walls 250 may be configured similarly.

The plurality of prefabricated demising walls 246, the plurality of prefabricated end walls 248, and the plurality of prefabricated bedroom walls 252 may be configured similarly. In particular, the plurality of prefabricated demising walls 246 may differ from one another only in length such that the plurality of prefabricated demising walls 246 may be considered to have a variable length. In like manner, the plurality of prefabricated end walls 248 may differ from one another only in length such that the plurality of prefabricated end walls 248 may be considered to have a variable length. Similarly, the plurality of prefabricated bedroom walls 252 may differ from one another only in length such that the plurality of prefabricated bedroom walls 252 may be considered to have a variable length. In the embodiments described herein, the lengths of the prefabricated demising, end, and bedroom walls 154, 156, 162 may vary to accommodate the widths of the various building unit floor plans. For instance, one building unit 110 may have a relatively narrower unit width $W_{Unit}$ requiring a relatively shorter demising wall 154, end wall 156, and/or bedroom wall 162. Similarly, another building unit 110 may have a relatively wider unit width $W_{Unit}$ requiring a relatively longer demising wall 154, end wall 156, and/or bedroom wall 162. Because the lengths of the demising walls 154, end walls 156, and bedroom walls 162 may be associated with the unit width $W_{Unit}$ of the building units 110, the lengths of the demising walls 154, end walls 156, and bedroom walls 162 may vary according to the width of the third floor panel 206.

The prefabricated walls 152 may be installed in any suitable manner. For example, and without limitation, the prefabricated walls 152 may be attached or otherwise coupled to the structural frame 102 (e.g., to the beams 122 of the structural frame 102) and/or to the floor system 200A, 200B (e.g., to any combination of the first, second, and third floor panels 202, 204, 206). For example, each demising wall 154 may be installed above and along at least one of the floor beams 122 extending between the first and second rows of columns 124, 126. Similarly, each end wall 156 may be installed adjacent (such as above and along) at least one of the floor beams 122 extending between the first and second rows of columns 124, 126 and along a terminal end of the building 100. Each utility wall 160 may be installed along a length of the building 100 and between adjacent floor beams 122, such as along a terminal side of the building 100. Similarly, each window wall 158 may be installed along a length of the building 100 and between adjacent floor beams 122, such as along a terminal side of the building 100 opposite the utility wall 160. Installing the window wall 158 may include attaching a window along corresponding tracks pre-installed on the prefabricated floor panels. Each bedroom wall 162 may be installed within the interior of the building unit 110 to partition the building unit 110 into a plurality of rooms, such as along a length and/or a width of the first, second, and/or third floor panels 202, 204, 206. In such embodiments, the connection structures of the prefabricated walls 152 may facilitate the prefabricated walls 152 to be easily attached or otherwise coupled to the structural frame 102 and/or to the floor system, such as by welding, bolting, interlocking structural features, or other suitable manner.

Figure 14:
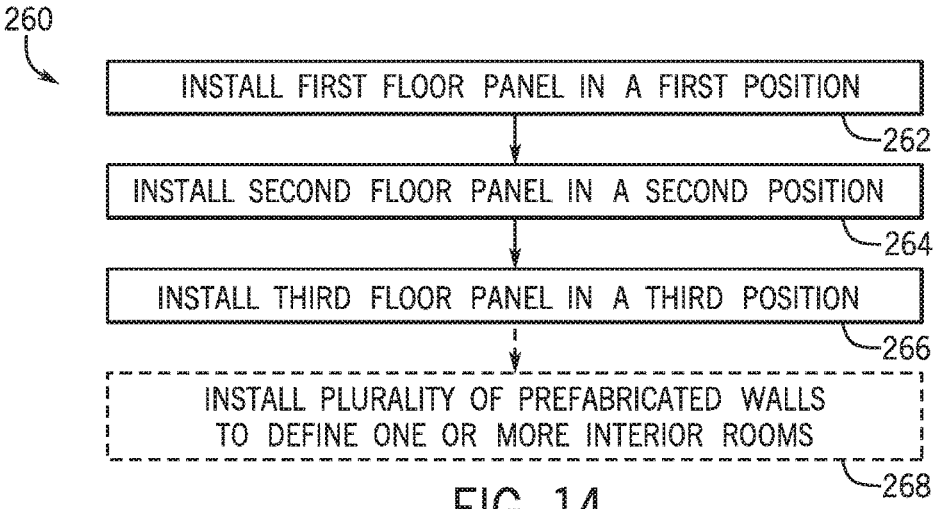
FIGS. 14-15 are flowcharts illustrating example methods of assembling a building unit in accordance with a floor plan of a building and using prefabricated components.
Figure 15:
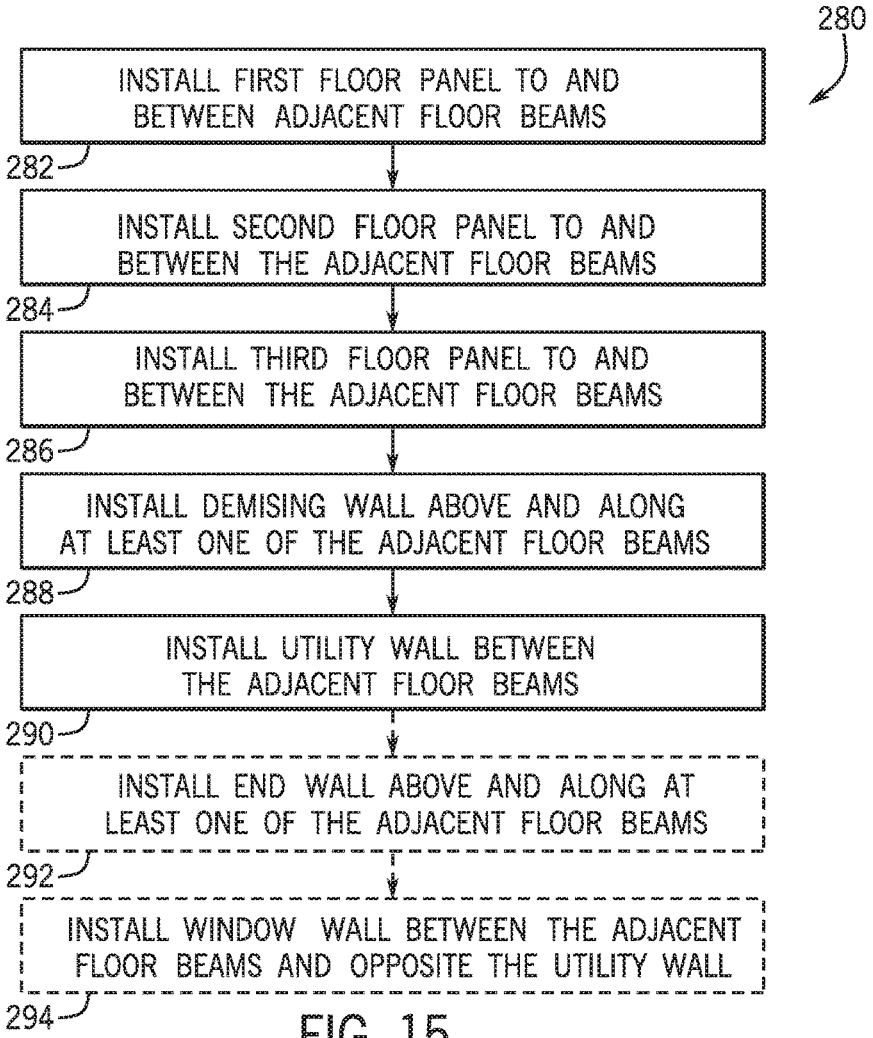

FIGS. 14 and 15 are flowcharts illustrating example methods of assembling a building unit 110 in accordance with a floor plan of a building 100 and using prefabricated components 106. The floor plan may be designed to provide a dimension of the building unit 110, such as the total width (e.g., the unit width $W_{Unit}$) and/or the total length (e.g., the unit length $L_{Unit}$) of the building unit 110. The methods may be used to construct a building, such as building 100, from a limited set of prefabricated components 106. The example methods may include one or more operations, functions, or actions as illustrated by one or more of blocks. Operations of the example methods will be described with reference also to FIGS. 1-13A, with the understanding that the various components shown in FIGS. 1-13A are merely illustrative, and suitable variations are contemplated.

Referring to FIG. 14, an example method 260 of assembling a building unit 110 in accordance with a floor plan of a building 100 using prefabricated components 106 includes installing a first prefabricated floor panel in a first position of the building unit 110 (see block 262). As explained above, the first floor panel 202 may be selected from a first plurality of prefabricated floor panels 220 having a same first width. The method 260 further includes installing a second prefabricated floor panel in a second position of the building unit 110 (see block 264). Like the first floor panel 202, the second floor panel 204 may be selected from a second plurality of prefabricated floor panels 222 having a same second width. The method 260 also includes installing a third prefabricated floor panel in a third position of the building unit 110 (see block 266). As noted above, the third floor panel 206 may be selected from a third plurality of prefabricated floor panels 224, the floor panels in the third plurality of prefabricated floor panels 224 having different widths. Depending on the particular application, the third floor panel 206 may be selected such that a sum of the widths of the first, second, and third floor panels 202, 204, 206 corresponds to the unit width $W_{Unit}$ of the building unit 110 in accordance with the floor plan.

The method 260 may include additional steps in some examples. For instance, the method 260 may include installing a plurality of prefabricated walls 152 to define one or more interior rooms 242 of the building unit 110 in accordance with the floor plan (see block 268 in phantom). In such examples, block 268 may include installing a prefabricated utility wall 160 along a terminal side of the building unit 110, such as along a length of the building 100. Additionally or alternatively, block 268 may include installing a prefabricated demising wall 154 along a terminal end of the building unit 110 to partition the building unit 110 from an adjacent building unit 110. Additionally or alternatively, block 268 may include installing a window wall 158 along a terminal side of the building unit 110 opposite the utility wall 160. Additionally or alternatively, block 268 may include installing a prefabricated end wall 156 along a terminal end of the building unit 110 opposite the demising wall 154. As explained above, the end wall 156 may be positioned to extend along a terminal end of the building 100. Additionally or alternatively, block 268 may include installing a prefabricated bedroom wall 162 within the interior of the building unit 110 to partition the building unit 110 into a plurality of rooms in accordance with the floor plan.

FIG. 15 illustrates another example method 280 of assembling a building unit 110 in accordance with a floor plan using prefabricated components 106. The method 280 may include installing a first prefabricated floor panel to and between adjacent floor beams 122 (see block 282). As explained above, the first floor panel 202 may be selected from a first plurality of prefabricated floor panels 220 having a same first width. The method 280 further includes installing a second prefabricated floor panel to and between the adjacent floor beams 122 (see block 284). Like the first floor panel 202, the second floor panel 204 may be selected from a second plurality of prefabricated floor panels 222 having a same second width. As shown, the method 280 includes installing a third prefabricated floor panel to and between the adjacent floor beams 122 (see block 286). As explained above, the third floor panel 206 may be selected from a third plurality of prefabricated floor panels 224, each floor panel in the third plurality of prefabricated floor panels 224 having a different width.

With continued reference to FIG. 15, the method 280 includes installing a prefabricated demising wall 154 above and along at least one of the adjacent floor beams 122 (see block 288). The demising wall 154, which may partition the building unit 110 from an adjacent building unit 110, may be selected from a plurality of prefabricated demising walls 246, each demising wall 154 in the plurality of prefabricated demising walls 246 having a different length. As shown, the method 280 also includes installing a prefabricated utility wall 160 between the adjacent floor beams 122 (see block 290). The utility wall 160, which may be positioned along a terminal side of the building unit 110, may be selected from a plurality of prefabricated utility walls 244, each utility wall 160 in the plurality of prefabricated utility walls 244 having a different length, as explained above.

The method 280 may include additional steps in some examples. For instance, the method 280 may include installing a prefabricated end wall 156 above and along at least one of the adjacent floor beams 122 (see block 292 in phantom). Like the other prefabricated walls, the end wall 156 may be selected from a plurality of prefabricated end walls 248, each end wall 156 in the plurality of prefabricated end walls 248 having a different length, as explained above. In some embodiments, the method 280 may include installing a window wall 158 between the adjacent floor beams 122 and along a terminal side of the building unit 110 opposite the utility wall(s) 160 (see block 294 in phantom).

Figure 16:
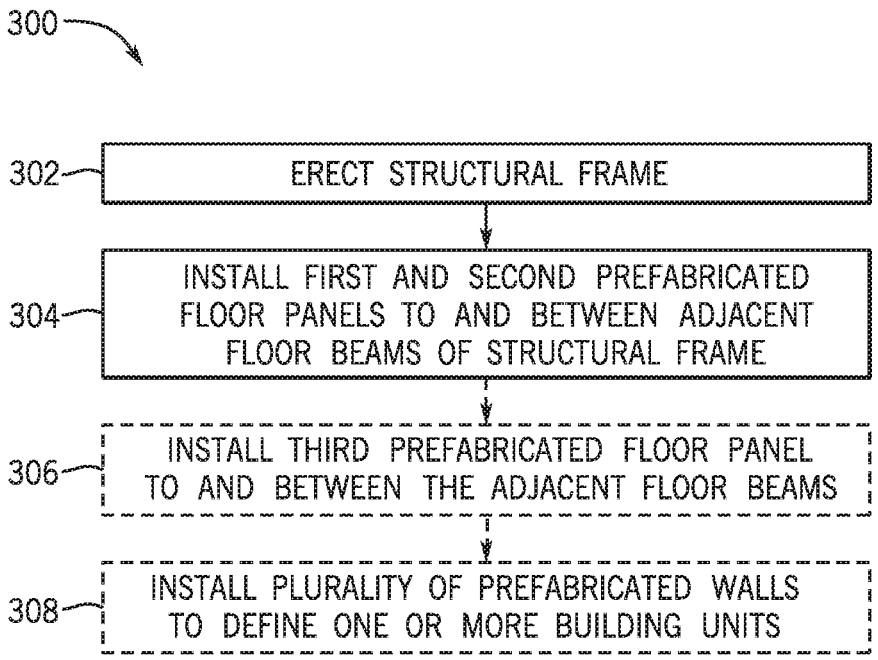
FIG. 16 is a flowchart illustrating an example method of constructing a building from a limited set of prefabricated components, the building having a length and a width.

FIG. 16 illustrates an example method 300 of constructing a building 100 from a limited set of prefabricated components 106, the building 100 having a length L and a width W. As shown, the method 300 includes erecting a structural frame 102 (see block 302). The structural frame 102 may include first and second rows of columns 124, 126 along the length L of the building 100 and a plurality of floor beams 122 coupled to and between the first and second rows of columns 124, 126 such that the floor beams 122 extend substantially parallel to one another along the width W of the building 100. At block 304, the method 300 includes installing first and second prefabricated floor panels to and between adjacent floor beams 122. The first floor panel 202 may have a width, and the second floor panel 204 may be selected from a plurality of prefabricated floor panels, each floor panel in the second plurality of prefabricated floor panels 222 having a different width. In such examples, the width of the second floor panel 204 may be selected such that a sum of the width of the first floor panel 202 and the width of the second floor panel 204 is less than or equal to the unit width $W_{Unit}$ of a building unit 110.

The method 300 may include additional steps in some examples. For instance, the method 300 may include installing a third prefabricated floor panel to and between the adjacent floor beams 122, the third floor panel 206 having a width (see block 306 in phantom). In such embodiments, the width of the second floor panel 204 may be selected such that the sum of the widths of the first, second, and third floor panels 202, 204, 206 corresponds to the unit width $W_{Unit}$ of the building unit 110. In some examples, the method 300 includes installing a plurality of prefabricated walls 152 to define one or more building units 110 of the building 100 (see block 308 in phantom). As noted above, the step of installing a plurality of prefabricated walls 152 may include installing a prefabricated utility wall 160, a prefabricated demising wall 154, a prefabricated end wall 156, a prefabricated bedroom wall 162, and/or a window wall 158 in any suitable combination.

The blocks included in the described example methods are for illustration purposes. In some embodiments, the blocks may be performed in a different order. In some embodiments, two or more blocks may be performed concurrently. In other embodiments, the blocks may be performed serially, with subsequent blocks not being performed until all previous blocks are fully completed. In some embodiments, various blocks may be eliminated. In still other embodiments, various blocks may be divided into additional blocks, supplemented with other blocks, or combined together into fewer blocks. Other variations of the illustrative blocks are contemplated, including changes in the order of the blocks, changes in the content of the blocks being split or combined into other blocks, etc. For example, blocks 262, 264, and 266 (as well as blocks 282, 284, and 286; and blocks 288 and 290) may be performed in reverse order or performed concurrently.

The present disclosure is not to be limited in terms of the particular examples described in this application, which are intended as illustrations of various aspects. Many modifications and examples can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and examples are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular examples only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to examples containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 items refers to groups having 1, 2, or 3 items. Similarly, a group having 1-5 items refers to groups having 1, 2, 3, 4, or 5 items, and so forth.

The herein described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

While various aspects and examples have been disclosed herein, other aspects and examples will be apparent to those skilled in the art. The various aspects and examples disclosed herein are for purposes of illustration and are not intended to be limiting, with the true scope and spirit being indicated by the following claims.

What is claimed is:

1. A method to assemble a building unit of a building in accordance with a floor plan of the building using prefabricated components, wherein the floor plan is designed to provide a total width of the building unit, the method comprising:

installing a first prefabricated floor panel in a first position of the building unit, wherein the first prefabricated floor panel is selected from a first plurality of prefabricated floor panels having a same first width;

installing a second prefabricated floor panel in a second position of the building unit, wherein the second prefabricated floor panel is selected from a second plurality of prefabricated floor panels having a same second width; and installing a third prefabricated floor panel in a third position of the building unit, wherein the third prefabricated floor panel is selected from a third plurality of prefabricated floor panels, wherein the prefabricated floor panels in the third plurality of prefabricated floor panels have different widths, and wherein the third prefabricated floor panel is selected such that a sum of the widths of the first, second, and third prefabricated floor panels corresponds to the total width of the building unit in accordance with the floor plan.

2. The method of claim 1, wherein the third prefabricated floor panel is positioned between the first and second prefabricated floor panels.

3. The method of claim 1, wherein the first, second, and third pluralities of prefabricated floor panels have a variable length, and wherein the first, second, and third prefabricated floor panels are selected to have a same length.

4. The method of claim 3, wherein the lengths of the first, second, and third prefabricated floor panels are selected to achieve a total length of the building unit.

5. The method of claim 1, wherein the first width of the first plurality of prefabricated floor panels is equal to the second width of the second plurality of prefabricated floor panels.

6. The method of claim 5, wherein the first and second widths of the first and second pluralities of prefabricated floor panels, respectively are greater than the widths of the third plurality of prefabricated floor panels.

7. The method of claim 1, further comprising installing a plurality of prefabricated walls to define one or more interior rooms of the building unit.

8. The method of claim 7, wherein installing the plurality of prefabricated walls comprises:

installing a prefabricated utility wall along a terminal side of the building unit; and installing a prefabricated demising wall along a terminal end of the building unit, wherein the prefabricated demising wall is configured to partition the building unit from an adjacent building unit.

9. The method of claim 8, wherein the first prefabricated floor panel is positioned adjacent to the utility wall.

10. The method of claim 8, wherein installing the plurality of prefabricated walls further comprises installing a prefabricated end wall along a terminal end of the building unit opposite the demising wall, and wherein the prefabricated end wall is positioned to extend along a terminal end of the building.

11. The method of claim 8, wherein installing the plurality of prefabricated walls further comprises installing a prefabricated bedroom wall within an interior of the building unit to partition the building unit into a plurality of rooms.

12. The method of claim 8, wherein installing the plurality of prefabricated walls further comprises installing a window wall along a terminal side of the building unit opposite the utility wall.

13. The method of claim 12, wherein the second prefabricated floor panel is positioned adjacent to the window wall.

14. A method to assemble a building unit in accordance with a floor plan using prefabricated components, the method comprising:

installing a first prefabricated floor panel to and between adjacent floor beams, wherein the first prefabricated floor panel is selected from a first plurality of prefabricated floor panels having a same first width;

installing a second prefabricated floor panel to and between the adjacent floor beams, wherein the second prefabricated floor panel is selected from a second plurality of prefabricated floor panels having a same second width;

installing a third prefabricated floor panel to and between the adjacent floor beams, wherein the third prefabricated floor panel is selected from a third plurality of prefabricated floor panels, wherein each prefabricated floor panel in the third plurality of prefabricated floor panels has a different width;

installing a prefabricated demising wall above and along at least one of the adjacent floor beams, wherein the prefabricated demising wall is selected from a plurality of prefabricated demising walls, wherein each demising wall in the plurality of prefabricated demising walls has a different length, and wherein the demising wall is configured to partition the building unit from an adjacent building unit; and installing a prefabricated utility wall between the adjacent floor beams, wherein the prefabricated utility wall is selected from a plurality of prefabricated utility walls, wherein each utility wall in the plurality of prefabricated utility walls has a different length, and wherein the utility wall is positioned along a terminal side of the building unit.

15. The method of claim 14, further comprising installing a window wall between the adjacent floor beams along a terminal side of the building unit opposite the prefabricated utility wall.

16. The method of claim 14, wherein the first prefabricated floor panel, the second prefabricated floor panel, and the third prefabricated floor panel have same lengths.

17. The method of claim 14, further comprising installing a prefabricated end wall above and along at least one of the adjacent floor beams, wherein the prefabricated end wall is selected from a plurality of prefabricated end walls, and wherein each prefabricated end wall in the plurality of prefabricated end walls has a different length.

18. The method of claim 17, wherein the lengths of the prefabricated demising and end walls vary according to the width of the prefabricated third prefabricated floor panel.

19. A method to construct a building from a limited set of prefabricated components, wherein the building has a length and a width, the method comprising:

erecting a structural frame, wherein the structural frame includes first and second rows of columns along the length of the building and a plurality of floor beams coupled to and between the first and second rows of columns such that the plurality of floor beams extend substantially parallel to one another along the width of the building; and installing first and second prefabricated floor panels to and between adjacent floor beams of the plurality of floor beams, wherein:

the first prefabricated floor panel has a width, the second prefabricated floor panel is selected from a plurality of prefabricated floor panels, wherein each floor panel in the second plurality of prefabricated floor panels has a different width, and the width of the second prefabricated floor panel is selected such that a sum of the width of the first prefabricated floor panel and the width of the second prefabricated floor panel is less than or equal to a total width of a building unit of the building.

20. The method of claim 19, further comprising installing a third prefabricated floor panel to and between the adjacent floor beams of the plurality of floor beams, wherein the third prefabricated floor panel has a width, wherein the width of the second prefabricated floor panel is selected such that a sum of the widths of the first, second, and third prefabricated floor panels corresponds to the total width of the building unit.

21. The method of claim 20, wherein the width of the third prefabricated floor panel is equal to the width of the first prefabricated floor panel.

22. The method of claim 20, wherein the second prefabricated floor panel is positioned between the first and third prefabricated floor panels.

23. The method of claim 19, further comprising installing a plurality of prefabricated walls to define one or more building units of the building.

24. The method of claim 23, wherein installing the plurality of prefabricated walls comprises:

installing a prefabricated utility wall along a first side of the building unit such that the prefabricated utility wall extends along at least a portion of the length of the building and at least partially defines an envelope of the building; and installing a prefabricated demising wall along a second side of the building unit such that the prefabricated demising wall extends along at least a portion of the width of the building, wherein the prefabricated demising wall is configured to partition the building unit from an adjacent building unit.

25. The method of claim 24, wherein installing the plurality of prefabricated walls further comprises installing a window wall opposite the utility wall.

26. The method of claim 24, wherein installing the plurality of prefabricated walls further comprises installing a prefabricated end wall opposite the demising wall, and wherein the prefabricated end wall is positioned to at least partially define the envelope of the building.

27. The method of claim 24, wherein installing the plurality of prefabricated walls further comprises installing a prefabricated bedroom wall within an interior of the building unit to partition the building unit into a plurality of rooms.

* * * * *